US011952844B2

(12) United States Patent
Donnally et al.

(10) Patent No.: US 11,952,844 B2
(45) Date of Patent: Apr. 9, 2024

(54) TUBULAR STRING BUILDING SYSTEM AND METHOD

(71) Applicant: National Oilwell Varco, L.P., Houston, TX (US)

(72) Inventors: Robert Benjamin Donnally, Houston, TX (US); Xilin Liu, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 295 days.

(21) Appl. No.: 17/427,436

(22) PCT Filed: Jan. 31, 2020

(86) PCT No.: PCT/US2020/016162
§ 371 (c)(1),
(2) Date: Jul. 30, 2021

(87) PCT Pub. No.: WO2020/160440
PCT Pub. Date: Aug. 6, 2020

(65) Prior Publication Data

US 2022/0127917 A1 Apr. 28, 2022

Related U.S. Application Data

(60) Provisional application No. 62/799,538, filed on Jan. 31, 2019.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15
See application file for complete search history.

(56) References Cited

U.S. PATENT DOCUMENTS 4,274,778 A * 6/1981 Putnam ..... E21B 19/14 414/733
4,397,605 A 8/1983 Cowgill et al.
(Continued)

FOREIGN PATENT DOCUMENTS

CA 2714327 A1 9/2004
CN 201347730 Y 11/2009
(Continued)

OTHER PUBLICATIONS

Mazerov: Rack & pinion technology takes shape in oilfield as multifunctional rigs, Drilling Contractor, Oct. 30, 2009.
(Continued)

*Primary Examiner* — Kenneth L Thompson
(74) *Attorney, Agent, or Firm* — Conley Rose, P.C.

(57) ABSTRACT

A well system includes a well platform including a rig floor, a first rig floor robot and a second rig floor robot positioned on the rig floor, wherein the first rig floor robot is configured to guide a lower end of a pipe stand towards a setback position on the rig floor and the second rig floor robot is configured to guide a first pipe joint of the pipe stand into a first mouse hole formed in the rig floor, a mast extending from the rig floor, a racking board coupled to the mast, the racking board configured to secure an upper end of the pipe stand between a pair of finger boards of the racking board, a racking board robot positioned on the racking board and configured to position the upper end of the pipe stand between the pair of finger boards.

18 Claims, 18 Drawing Sheets

(56) References Cited

U.S. PATENT DOCUMENTS

| | | | | |
|---|---|---|---|---|
| 4,474,520 | A | 10/1984 | Buckner et al. | |
| 4,494,899 | A | 1/1985 | Hoang et al. | |
| 4,621,974 | A * | 11/1986 | Krueger | E21B 19/20 414/800 |
| 5,423,390 | A | 6/1995 | Donnally et al. | |
| 5,609,457 | A | 3/1997 | Burns | |
| 7,246,983 | B2 | 7/2007 | Zahn et al. | |
| 7,736,119 | B2 | 6/2010 | Belik | |
| 7,992,646 | B2 | 8/2011 | Wright et al. | |
| 8,167,038 | B2 | 5/2012 | Boutwell et al. | |
| 8,215,887 | B2 | 7/2012 | Fikowski et al. | |
| 8,550,761 | B2 * | 10/2013 | Belik | E21B 19/155 414/22.63 |
| 8,839,881 | B1 | 9/2014 | Baumler | |
| 8,851,164 | B2 | 10/2014 | Ellis et al. | |
| 9,212,526 | B1 | 12/2015 | Barnes et al. | |
| 9,212,778 | B2 † | 12/2015 | Winter | |
| 9,587,449 | B2 * | 3/2017 | Huseman | E21B 19/06 |
| 9,752,395 | B2 † | 9/2017 | Roodenburg | |
| 9,926,753 | B2 | 3/2018 | Magnuson et al. | |
| 9,951,572 | B2 | 4/2018 | Magnuson | |
| 10,053,934 | B2 * | 8/2018 | Keogh | E21B 19/24 |
| 10,927,603 | B2 * | 2/2021 | Berry | E21B 19/20 |
| 11,591,863 | B2 * | 2/2023 | Basile | E21B 19/155 |
| 11,613,932 | B2 * | 3/2023 | Saebo | E21B 19/14 175/57 |
| 2015/0016925 | A1 | 1/2015 | Larkin | |
| 2016/0076317 | A1 | 3/2016 | Larkin | |
| 2016/0312543 | A1 | 10/2016 | Cheng et al. | |
| 2017/0234088 | A1 | 8/2017 | Orr et al. | |
| 2017/0321490 | A1 | 11/2017 | Haavind | |
| 2018/0179836 | A1 | 6/2018 | Ferrari | |
| 2018/0245409 | A1 | 8/2018 | Berry et al. | |
| 2018/0298693 | A1 | 10/2018 | Van Duivendijk et al. | |

FOREIGN PATENT DOCUMENTS

| | | | | |
|---|---|---|---|---|
| CN | 201614893 | U | 10/2010 | |
| CN | 202661460 | U | 1/2013 | |
| CN | 103306617 | A | 9/2013 | |
| CN | 103437723 | A | 12/2013 | |
| CN | 104563918 | A | 4/2015 | |
| CN | 105672874 | A | 6/2016 | |
| CN | 107829696 | A | 3/2018 | |
| CN | 111911097 | A * | 11/2020 | |
| CN | 115434650 | A * | 12/2022 | |
| KR | 101750823 | B1 | 6/2017 | |
| WO | WO-2019231798 | A1 * | 12/2019 | E21B 19/08 |

OTHER PUBLICATIONS

International Search Report and Written Opinion dated Jun. 2, 2020, for Application No. PCT/US2020/016162.

Schlumberger Energy Glossary accessed Jul. 14, 2022, https://glossary.slb.com/en/terms/m/mousehole.†

Schlumberger Energy Glossary accessed Jul. 14, 2022, https://glossary.slb.com/en/terms/d/drawworks.†

* cited by examiner
† cited by third party

TUBULAR STRING BUILDING SYSTEM AND METHOD

CROSS-REFERENCE TO RELATED APPLICATIONS

The present application is a 35 U.S.C. § 371 national stage application of PCT/US2020/016162 filed Jan. 31, 2020, and entitled "Tubular String Building System and Method," which claims benefit of U.S. provisional patent application No. 62/799,538 filed on Jan. 31, 2019, entitled "Tubular String Building System and Method" both of which are incorporated herein by reference in their entirety.

STATEMENT REGARDING FEDERALLY SPONSORED RESEARCH OR DEVELOPMENT

Not applicable.

BACKGROUND

Well systems configured for the production of oil and gas include running tubular members or drill pipes into and out of a borehole of the well system that extends into a subterranean earthen formation. In some applications, the individual drill pipe joints are transported from a storage area distal a drilling platform of the well system to a rig floor of the drilling platform utilizing a catwalk or other system configured to transport the pipe joint. Once on the rig floor, the pipe joint may be threadably connected to another drill pipe joint to form a pipe stand. The assembled pipe stands may be stored in a setback position on the rig floor, the upper end of each pipe stand being secured in a racking board that is elevated from the rig floor. During a drilling operation performed by the well system, pipe stands may be sequentially removed from the setback position and coupled to a drill string for inserting into a borehole of the well system. In some applications, an elevator attached to a mast of the drilling platform may be used to assist in manipulating the pipe stand when it is coupled to the drill string.

SUMMARY

An embodiment of a well system comprises a well platform comprising a rig floor, a first rig floor robot and a second rig floor robot positioned on the rig floor, wherein the first rig floor robot is configured to guide a lower end of a pipe stand towards a setback position on the rig floor and the second rig floor robot is configured to guide a first pipe joint of the pipe stand into a first mouse hole formed in the rig floor, a mast extending from the rig floor, a racking board coupled to the mast, the racking board configured to secure an upper end of the pipe stand between a pair of finger boards of the racking board, and a racking board robot positioned on the racking board and configured to position the upper end of the pipe stand between the pair of finger boards. In some embodiments, the first rig floor robot, the second rig floor robot, and the racking board robot each comprise a guide member having six degrees of freedom. In some embodiments, the first rig floor robot comprises a rotary platform, a first rotary actuator coupled to the rotary platform and configured to rotate the rotary platform about a first rotational axis, a first pivot arm pivotably coupled to the rotary platform, a second pivot arm pivotably coupled to the first pivot arm, a second rotary actuator coupled to the second pivot arm and configured to rotate the second pivot arm about a second rotational axis, and a claw pivotably coupled to the second pivot arm. In certain embodiments, the first rig floor robot is slidably disposed on a track positioned on the rig floor. In certain embodiments, the second rig floor robot is configured to guide a second pipe joint of the pipe stand into a second mouse hole formed in the rig floor that is spaced from the first mouse hole. In some embodiments, the well system further comprises a pipe transport assembly slidably coupled to one of the legs of the mast, wherein the pipe transport assembly comprises an elevator configured to transport the pipe stand. In some embodiments, the well system further comprises an actuator coupled to the mast and configured to raise and lower the pipe transport assembly along a rail coupled to the mast.

An embodiment of a well system comprises a rig floor, a first rig floor robot positioned on the rig floor, wherein the first rig floor robot is configured to guide a lower end of a pipe stand towards a setback position on the rig floor, a mast extending from the rig floor, the mast comprising a plurality of legs, a pipe transport assembly slidably coupled to one of the legs of the mast, wherein the pipe transport assembly comprises an elevator configured to transport the pipe stand, and a winch coupled to the mast and configured to raise and lower the pipe transport assembly along the mast. In some embodiments, the pipe transport assembly comprises a mounting frame slidably coupled to the mast, a swing arm pivotably coupled to the mounting frame at a first pivot joint, a first pivot actuator coupled between the swing arm and the mounting frame, wherein the first pivot actuator is configured to selectably rotate the swing arm relative to the mounting frame about a first pivot axis. In some embodiments, the pipe transport assembly comprises an elevator comprising a support frame pivotably coupled to the swing arm at a second pivot joint, a pipe support member pivotably coupled to the support frame at a third pivot joint, a second pivot actuator coupled between the support frame and the pipe support member, wherein the second pivot actuator is configured to selectably rotate the pipe support member relative to the support frame about a second pivot axis, and a locking member pivotably coupled to the pipe support member, wherein the locking member comprises an open position and a closed position. In certain embodiments, the pipe transport assembly is configured to transport the pipe stand vertically in response to actuation of the winch, and the pipe transport assembly is configured to transport the pipe stand horizontally when the pipe stand is in a vertical orientation in response to actuation of the first pivot actuator. In certain embodiments, the well system further comprises a second rig floor robot positioned on the rig floor and configured to guide a first pipe joint of the pipe stand into a first mouse hole formed in the rig floor, a racking board coupled to the mast, the racking board configured to secure an upper end of the pipe stand between a pair of finger boards of the racking board, and a racking board robot positioned on the racking board and configured to position the upper end of the pipe stand between the pair of finger boards. In some embodiments, the first rig floor robot, the second rig floor robot, and the racking board robot each comprise a guide member having six degrees of freedom. In some embodiments, the first rig floor robot comprises a rotary platform, a first rotary actuator coupled to the rotary platform and configured to rotate the rotary platform about a first rotational axis, a first pivot arm pivotably coupled to the rotary platform, a second pivot arm pivotably coupled to the first pivot arm, a second rotary actuator coupled to the second pivot arm and configured to rotate the second pivot arm about a second rotational axis, and a claw pivotably coupled to the second pivot arm.

An embodiment of a method for assembling a pipe stand of a well system comprises (a) lowering a first pipe joint into a first mouse hole of a rig floor using a pipe transport assembly, (b) lowering a second pipe joint into a second mouse hole of the rig floor using the pipe transport assembly, (c) guiding a lower end of a third pipe joint into engagement with an upper end of the second pipe joint using a first rig floor robot positioned on the rig floor, (d) guiding a lower end of the second pipe joint into engagement with an upper end of the first pipe joint using a first rig floor robot positioned on the rig floor to form the pipe stand from the first, second, and third pipe joints, and (e) pivoting an upper end of the pipe stand using a racking board robot positioned on a racking board disposed above the rig floor while a lower end of the pipe stand is supported on the rig floor. In some embodiments, the method further comprises (f) lifting the first pipe joint from a pipe ramp positioned adjacent the rig floor, and (g) lifting second first pipe joint from a pipe ramp positioned adjacent the rig floor. In some embodiments, the method further comprises (f) pivoting a swing arm of the pipe transport assembly to displace the third pipe joint in a first lateral direction and align a central axis of the third pipe joint with a central axis of the second pipe joint. In certain embodiments, the method further comprises (g) pivoting the swing arm of the pipe transport assembly to displace the second pipe joint in a second lateral direction opposite the first lateral direction and align the central axis of the second pipe joint with a central axis of the first pipe joint. In certain embodiments, (a) comprises actuating a winch coupled to a mast extending from the rig floor to slidably displace the pipe transport assembly along a rail coupled to the mast. In some embodiments, the method further comprises (f) guiding a lower end of the pipe stand toward a setback position using a second rig floor robot positioned on the rig floor.

BRIEF DESCRIPTION OF THE DRAWINGS

For a detailed description of exemplary embodiments, reference will now be made to the accompanying drawings in which.

DETAILED DESCRIPTION

Figure 1:
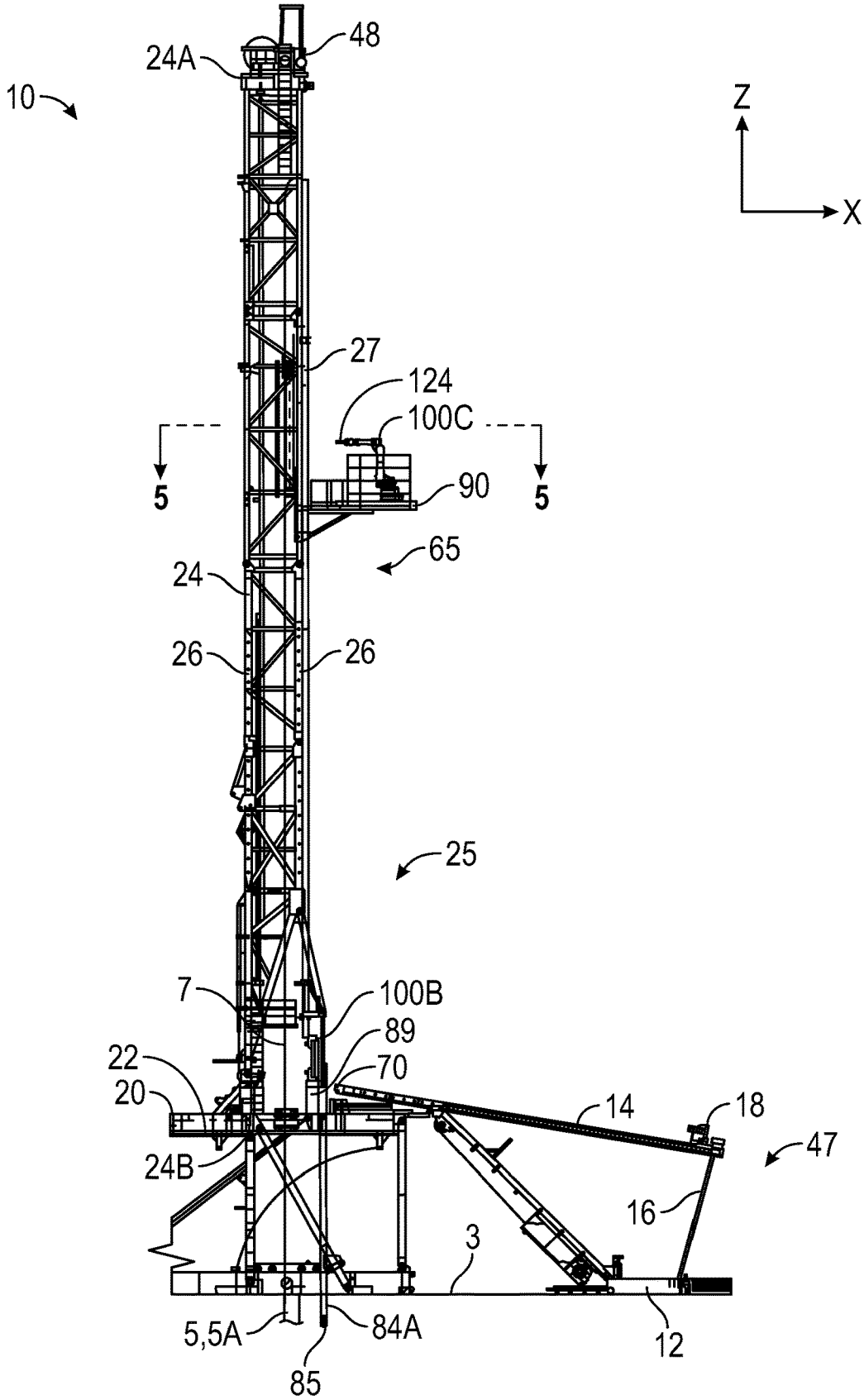
FIG. 1 is a side view of an embodiment of a well system in accordance with principles disclosed herein.
Figure 2:
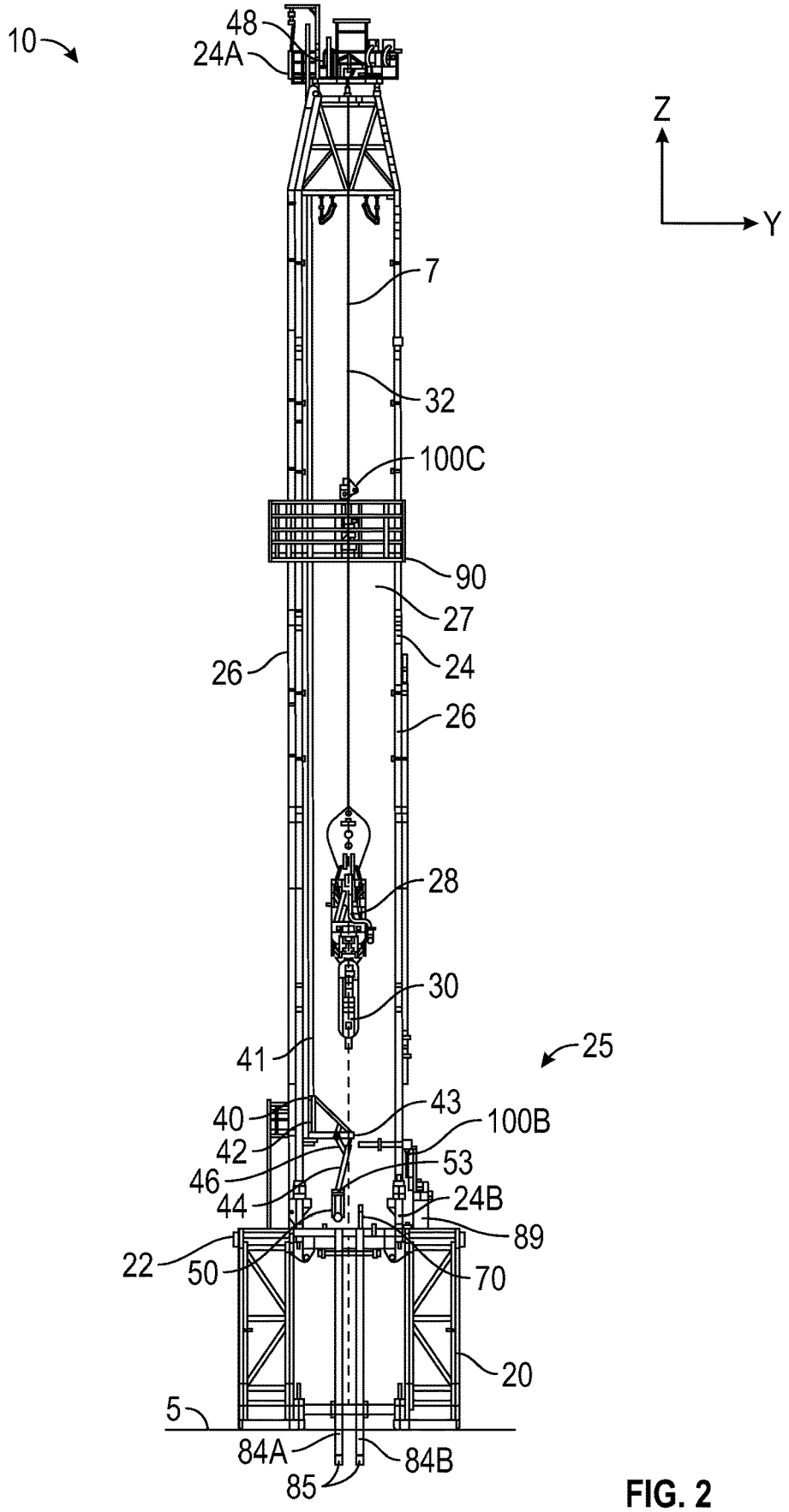
FIGS. 2 and 3 are front views of the well system of FIG. 1 in a first position.
Figure 3:
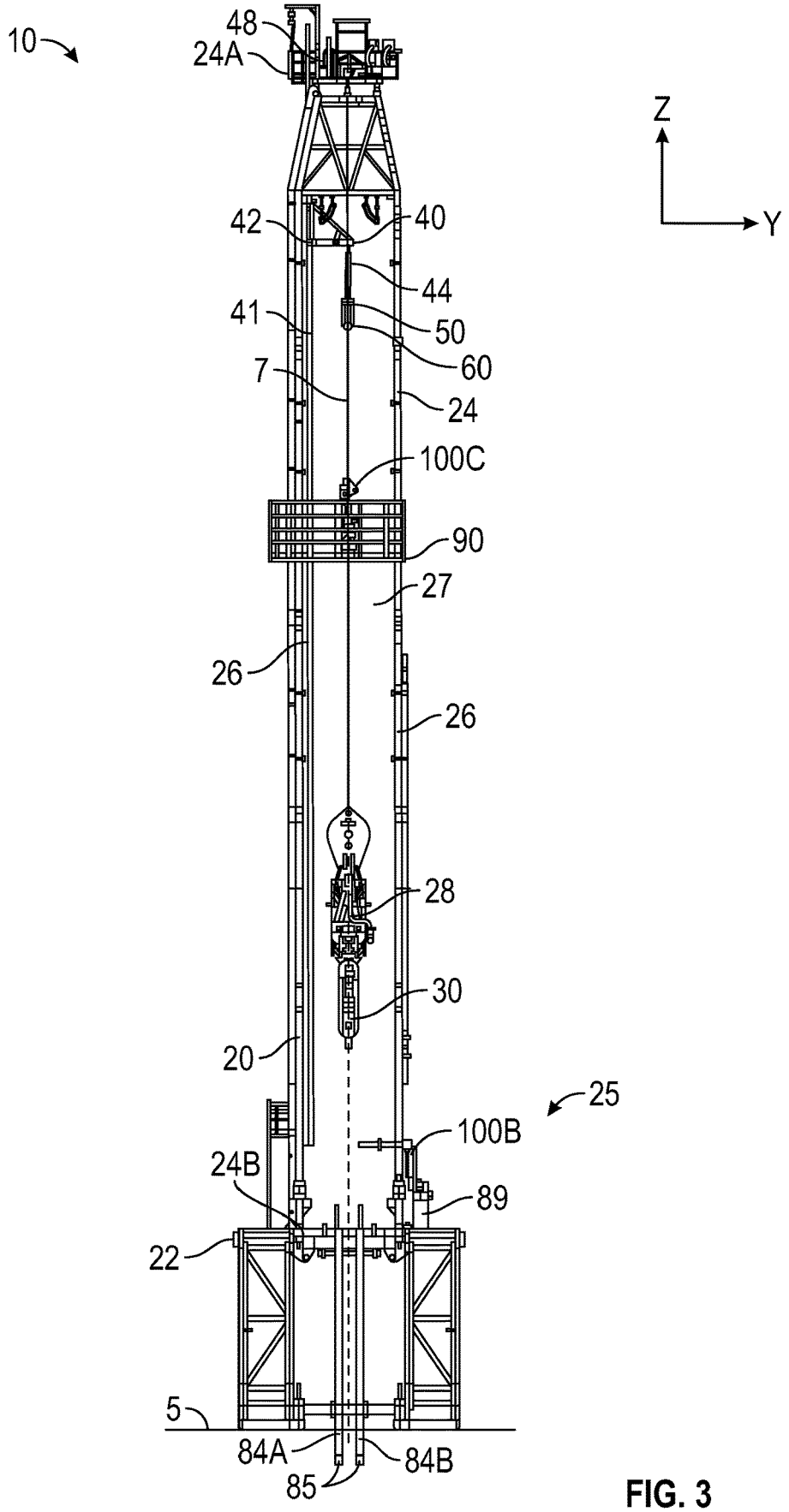
Figure 4:
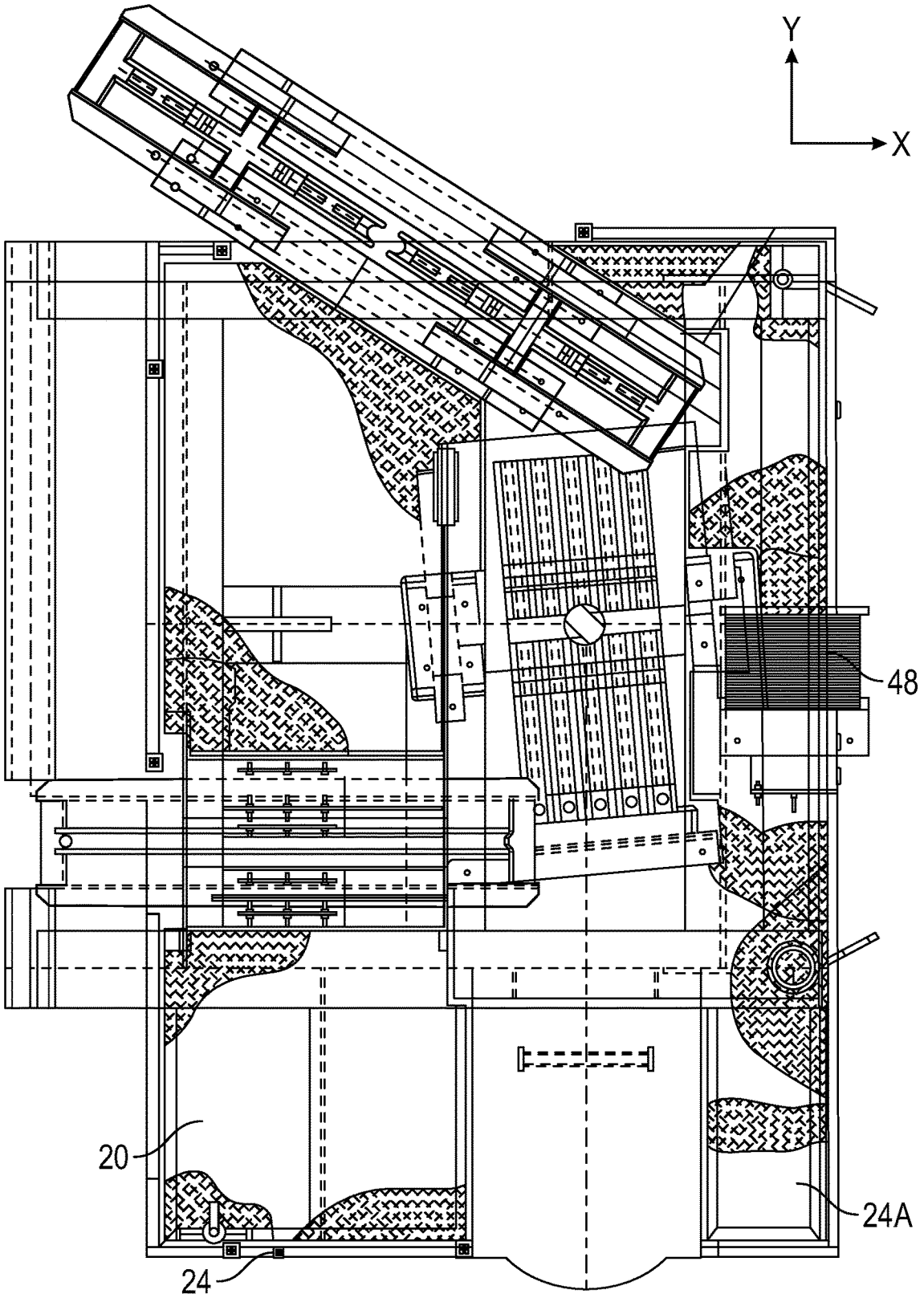
FIG. 4 is a top view of the well system of FIG. 1.
Figure 5:
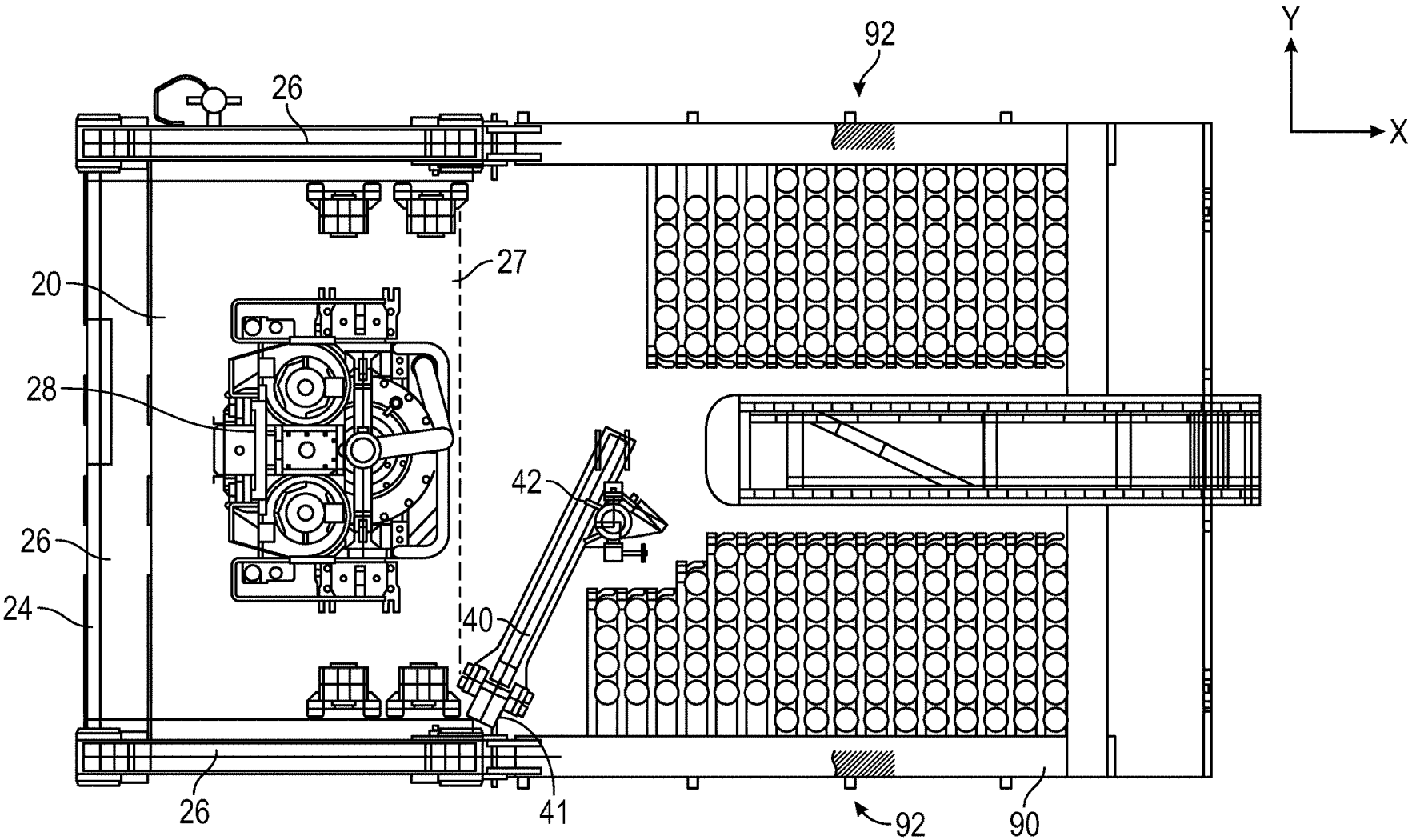
FIG. 5 is a cross-sectional view of the well system of FIG. 1 along line 5-5 of FIG. 1.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIGS. 1-12, an embodiment of a well system 10 for forming a wellbore 5 extending into a subterranean earthen formation is shown. As will be described further herein, well system 10 includes a tubular string building and transport system 25 for assembling drill pipe joints 70 into tubular strings or pipe stands 140 (shown in FIG. 19) and positioning assembled pipe stands 140 in a setback position 65 relative to a central axis or well centerline 7 of an upper or vertical section 5A of wellbore 5. Particularly, well centerline 7 extends parallel with a vertically extending (relative the surface 3) "Z" coordinate axis and setback position 65 is spaced from well centerline 7 along a horizontally extending (relative the surface 3) "X" coordinate axis. Well system 10 generally includes a well or drilling platform 12 and a pipe transporter or ramp 80, each of which are supported on the surface 3 from which wellbore 5 extends. Drilling platform 20 includes a rig floor 22 spaced from the surface 3 and a mast 24 that extends vertically from the rig floor 22.

Pipe ramp 12 is generally configured to transport pipe joints 70 to the rig floor 22 of drilling platform 20 from a storage position 47 on the surface 3 distal rig floor 22. In this embodiment, pipe ramp 12 generally includes a pipe transport or support surface 14, a pivot assembly 16, and a pipe actuator or pusher 18. Pipe support surface 14 is configured to support drill pipe joints 70 as they are transferred from the storage position 47 to the rig floor 22. Pivot assembly 16 comprises one or more actuators and pivotable links and is configured for pivoting pipe support surface 14 from a substantially horizontal position (relative surface 3) and an inclined position (shown in FIG. 1). In the horizontal position, a drill pipe joint 70 disposed in a substantially horizontal orientation in the storage position 47 may be loaded onto pipe support surface 14.

Once a drill pipe joint 70 is loaded onto pipe support surface 14, pivot assembly 16 may be actuated to dispose pipe support surface 14 in the inclined position such that the loaded drill pipe joint 70 may be transported to the rig floor 22 of drilling platform 20. Pusher 18 of pipe ramp 12 is configured to apply a force against an end of the drill pipe joint 70 loaded onto pipe support surface 14 to thereby transport the drill pipe joint 70 along pipe support surface 14 towards the rig floor 22 such that at least a portion of the drill pipe joint 70 is positioned vertically over the rig floor 22 in an inclined position, as shown particularly in FIG. 1. Although in this embodiment well system 10 includes pipe ramp 12 for transporting pipe joints 70 between the storage position 47 and the rig floor 22 of drilling platform 20, in other embodiments, well system 10 may comprise other mechanisms or systems for transporting pipe joints 70 between storage position 47 and the rig floor 22.

In this embodiment, mast 24 of drilling platform 20 extends along a central or longitudinal axis coaxial with well centerline 7 between a first or upper end 24A distal rig floor 22 and a second or lower end 24B positioned at rig floor 22. Mast 24 comprises a plurality of legs 26 that extend vertically (relative to surface 3) between upper end 24A and lower end 24B. Particularly, in this embodiment, mast 24 comprises four vertically extending legs 26 disposed in a U-shaped configuration forming an opening or open side 27 of mast 24; however, in other embodiments, mast 24 may be configured differently. A top drive assembly 28 aligned with well centerline 7 and including an elevator 30. Top drive assembly 28 is positioned within mast 24, top drive assembly 28 being suspended from a drawworks cable 32 extending from the upper end 24A of mast 24. Top drive assembly 28 may be vertically raised and lowered relative surface 3 via the actuation of drawworks cable 32 and is configured for running pipe stands 140 of assembled drill pipe joints 70 into and out of wellbore 5 as part of a drilling operation of well system 10.

The mast 24 of drilling platform 20 includes a pipe transport assembly 40 slidably attached to one of the legs 26 of mast 24 positioned proximal pipe ramp 12. As shown particularly in FIGS. 2 and 8-12, pipe transport assembly 40 generally includes a support or mounting frame 42, a swing arm 44, and an elevator 50. Mounting frame 42 is slidably coupled to a track or rail 41 that extends along one of the legs 26 of mast 24 and is configured to physically support swing arm 44 and elevator 50, each of which are suspended from mounting frame 42. Pipe transport assembly 40 may be raised and lowered along track 41 (i.e., raised and lowered along a longitudinal axis parallel with, but offset from, well centerline 7) via a winch 48 positioned at the upper end 24A of mast 24. In this embodiment, a cable extends between winch 48 and pipe transport assembly 40, the retraction and extension of which causing the raising and lowering of pipe transport assembly 40 along track 41; however, in other embodiments, other mechanisms may be employed for raising and lowering pipe transport assembly 40 along track 41.

An upper end of the swing arm 44 (shown particularly in FIG. 2) of pipe transport assembly 40 is pivotably connected to mounting frame 42 at a first pivot joint 43. The first pivot joint 43 of pipe transport assembly 40 permits swing arm 44 to pivot relative to mounting frame 42 along a horizontally extending first pivot axis that is disposed parallel with the X coordinate axis (shown in FIG. 1). Pipe transport assembly 40 includes a first pivot actuator 46 coupled between mounting frame 42 and swing arm 44 for selectively controlling the pivot position of swing arm 44 relative to mounting frame 42 about the first pivot axis. Thus, first pivot actuator 46 may be controlled (e.g., via a controller in signal communication with first pivot actuator 46) to control the pivoting of swing arm 44 about the first pivot axis extending through first pivot joint 43.

As shown particularly in FIGS. 8-12, in this embodiment, the elevator 50 of pipe transport assembly 40 includes a support frame 52, a pivot frame 56, and a cylindrical pipe support member 60, and an arcuate locking member 64. Support frame 52 of elevator 50 is pivotably attached to a lower end of swing arm 44 at a second pivot joint 53. Second pivot joint 53 permits elevator 50 to pivot relative swing arm 44 about a horizontally extending second pivot axis that is disposed parallel with the X coordinate axis (shown in FIG. 1). In this manner, a longitudinal axis 55 of elevator 50 may extend parallel to well centerline 7 and the X coordinate axis irrespective of the relative position between the swing arm 44 and the mounting frame 42 of pipe transport assembly 40. In other words, as swing arm 44 is pivoted about the first pivot axis of first pivot joint 43 in response to the actuation of pivot actuator 46, elevator 50 pivots about the second pivot axis of second pivot joint 53 to thereby maintain the parallel relationship between the longitudinal axis 55 of elevator 50 and well centerline 7.

The support frame 52 of elevator 50 includes a pair of longitudinally extending arms 54 which pivotably couple to the pivot frame 56 at a pair of third pivot joints 58. Third pivot joints 58 permit pivot frame 56 to pivot relative to the support frame 52 of elevator about a third pivot axis that is disposed parallel with a horizontally extending (relative to the surface 3) "Y" coordinate axis (shown in FIG. 2). A second pivot actuator 62 is pivotably coupled between support frame 52 and pivot frame 56 for selectively controlling the pivot position of pivot frame 56 relative to support frame 54 relative to the third pivot axis. Thus, second pivot actuator 62 may be controlled (e.g., via a controller in signal communication with second pivot actuator 62) to control the pivoting of pivot frame 56 about the third pivot axis.

The pipe support member 60 and locking member 64 of elevator 50 are configured to selectively lock a first or box end 71 (shown in FIG. 10) of a drill pipe joint 70 such that pipe transport assembly 40 may transport and manipulate the drill pipe joint 70. In this embodiment, pipe support member 60 includes an internal shoulder 63 configured to engage an external shoulder of the box end 71 of drill pipe joint 70. Pipe support member 60 is coupled to pivot frame 56 at joints 61. In this embodiment, pipe support member 60 is rotationally locked to pivot frame 56. Locking member 64 is pivotably coupled to pipe support member 60 via a lock actuator 66 coupled therebetween. Lock actuator 66 is configured to actuate locking member 64 (e.g., in response to an actuation signal transmitted to lock actuator 66 from a controller) between a closed or locked position (shown in FIG. 11) and an unlocked or open position (shown in FIG. 12). In the open position of locking member 64, the box end 71 of a drill pipe joint 70 may be inserted into or removed from pipe support member 60. However, when locking member 64 is in the closed position, the box end 71 of the drill pipe joint 70 received in pipe support member 60 is locked to pipe support member 60 and elevator 50. Thus, when locking member 64 is disposed in the closed position, the drill pipe joint 70 received in pipe support member 60 may be manipulated and transported by pipe transport assembly 40, as will be described further herein.

As will be described further herein, the combination of pivot joints 43, 53 and 58 permit pipe transport assembly 40 to displace a drill pipe joint 70 secured thereto vertically along an axis parallel with the Z coordinate axis and horizontally along an axis parallel with the Y coordinate axis while maintaining a substantially vertical orientation of the drill pipe joint 70. In other words, a drill pipe joint 70 may be moved along axes parallel with the Z, X, and Y coordinate axes while maintaining substantial, parallel alignment between a central or longitudinal axis 75 (shown in FIG. 10) of the drill pipe joint 70 and well centerline 7. For example, a drill pipe joint 70 secured to pipe transport assembly 40 may be displaced vertically along an axis parallel with the Z coordinate axis while maintaining a substantially vertical orientation by actuating winch 48 and displacing pipe transport assembly 40 along the leg 26 of mast 24. Additionally, the drill pipe joint 70 may be displaced horizontally along an axis parallel with the Y coordinate axis while maintaining a substantially vertical orientation by actuating first pivot actuator 46 of pipe transport assembly 40. Further, the drill pipe joint 70 secured to pipe transport assembly 40 may be rotated about the third pivot axis relative to support frame 52 of elevator 50 by actuating the second pivot actuator 62 of pipe transport assembly 40.

Figure 6:
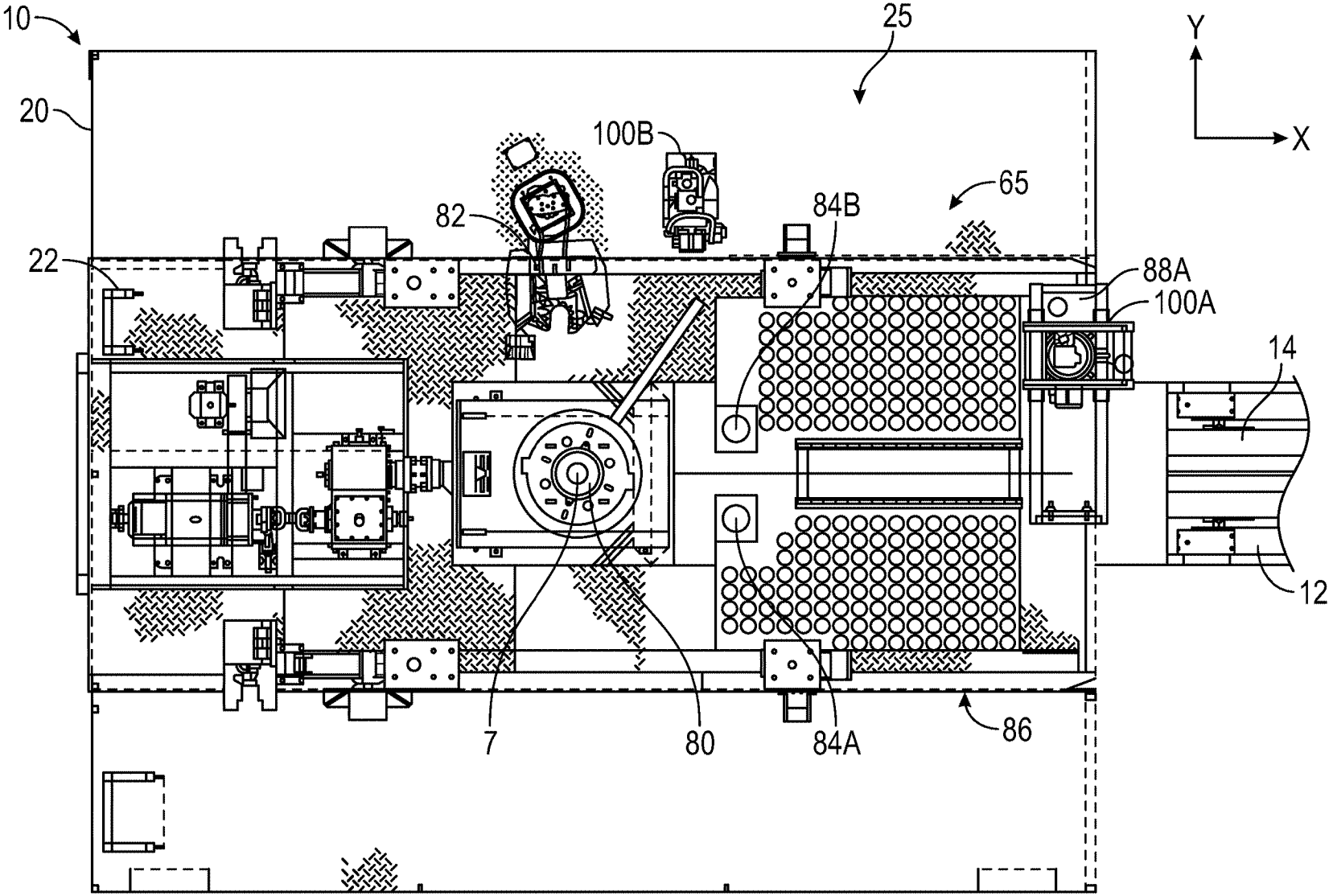
FIG. 6 is a top view of an embodiment of a rig floor of the well system of FIG. 1 in accordance with principles disclosed herein.

As shown particularly in FIG. 6, the rig floor 22 of drilling platform 20 includes a rotary table 80 disposed about well centerline 7 and a power tong 82 positioned adjacent the rotary table 80. Additionally, rig floor 22 includes a pair of mouse holes 84A, 84B each positioned between the well centerline 7 and the setback position 65. Particularly, each mouse hole 84A, 84B is offset from the well centerline 7 both along the horizontal X coordinate axis and the Y coordinate axis. As will be discussed further herein, each mouse hole 84A, 84B has a longitudinal length configured to receive a single drill pipe joint 70 in a substantially vertical orientation. Additionally, in this embodiment, the rig floor 22 includes a plurality includes a pip stand support deck 86 disposed in the setback position 65. Support deck 86 is configured to support the lower end of each assembled pipe stand 140 disposed in the setback position 65, as will be discussed further herein.

In this embodiment, a pair of robots 100A, 100B are also positioned on the rig floor 22 of drilling platform 20. As will be discussed further herein, rig floor robots 100A, 100B are configured to assisting in the assembling of pipe stands 140 from drill pipe joints 70 and the positioning of the assembled pipe stands 140 in the setback position 65. First robot 100A is slidably disposed on rig floor 22. Particularly, first robot 100A may be displaced along a track 88 extending longitudinally along an axis parallel to the Y coordinate axis. In this embodiment, second robot 100B is mounted on a platform 89 extending vertically from rig floor 22. In this configuration, first robot 100A is positioned in the setback position 65 while second robot 100B is positioned proximal mouse holes 84A, 84B.

Figure 7:
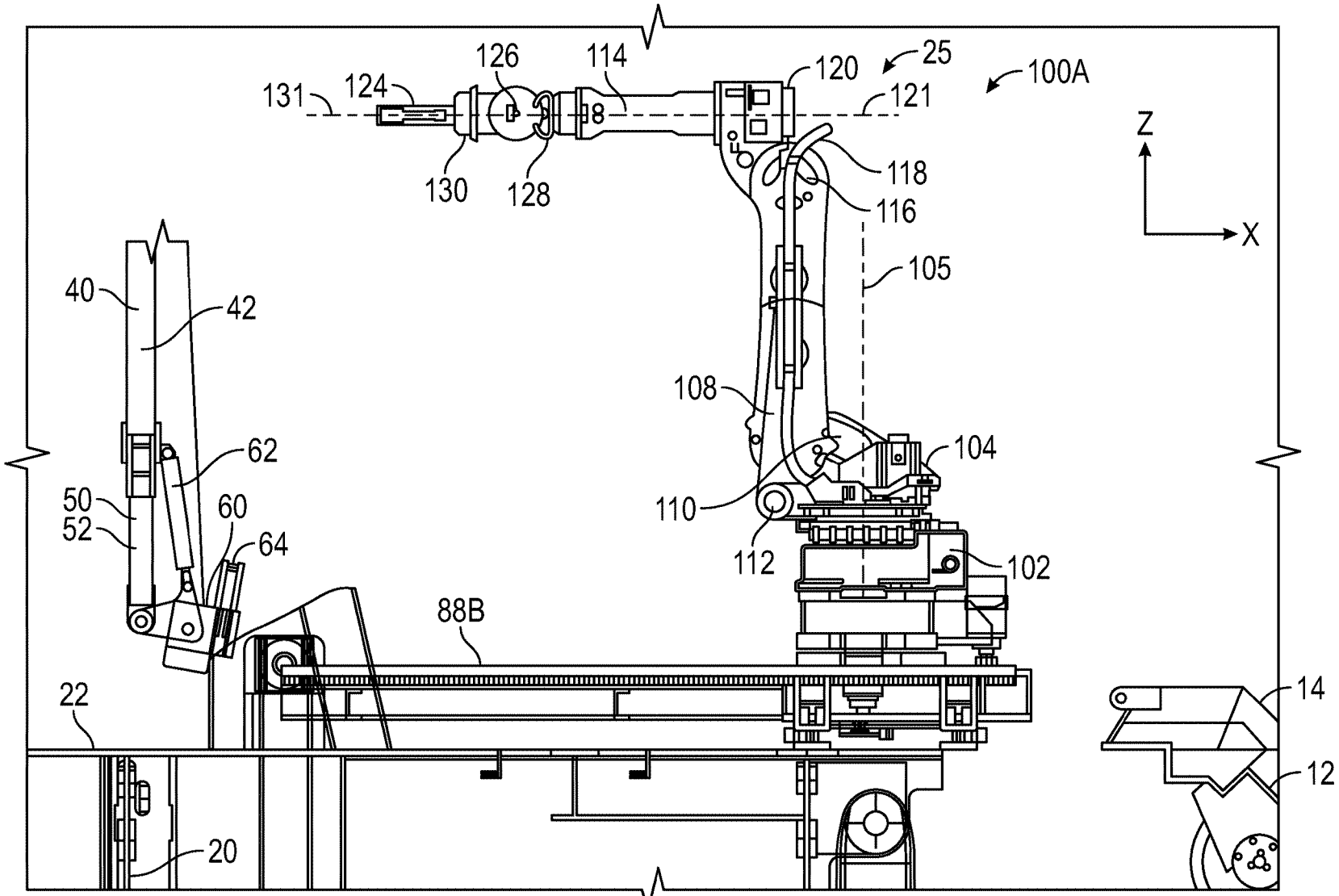
FIG. 7 is a front view of an embodiment of a robot of the well system of FIG. 1 in accordance with principles disclosed herein.
Figure 10:
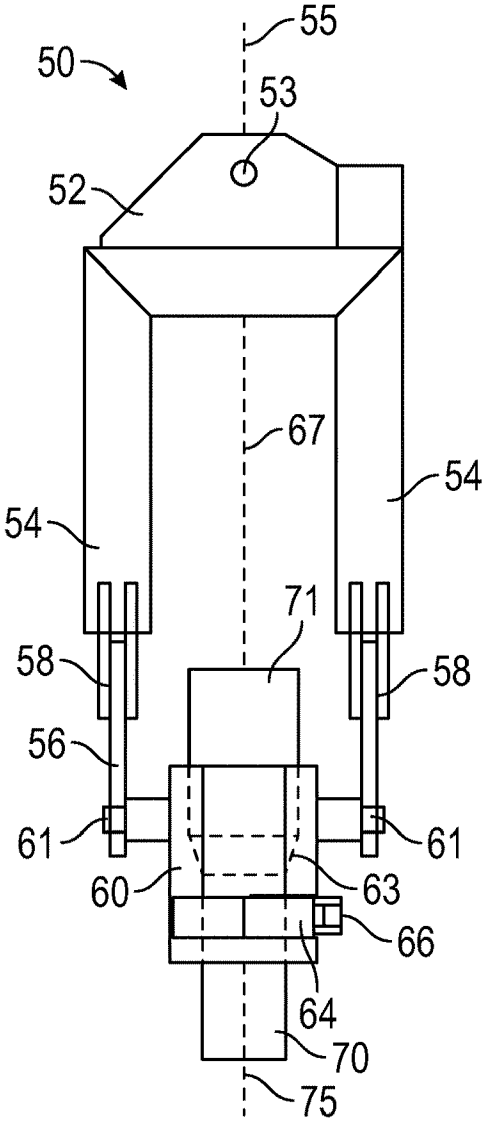
FIG. 10 is another side view of the pipe transport assembly of FIG. 8.
Figure 9:
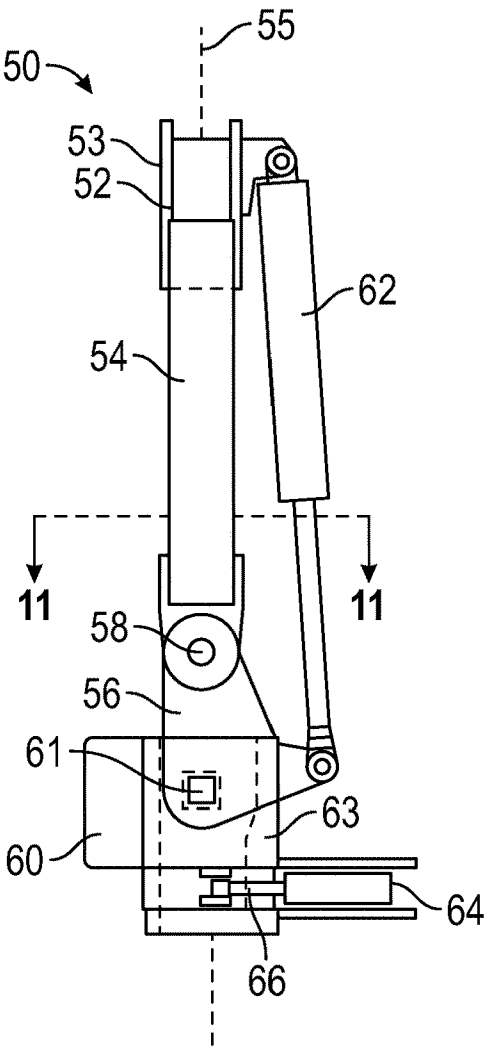
FIG. 9 is a front view of the pipe transport assembly of FIG. 8.
Figure 8:
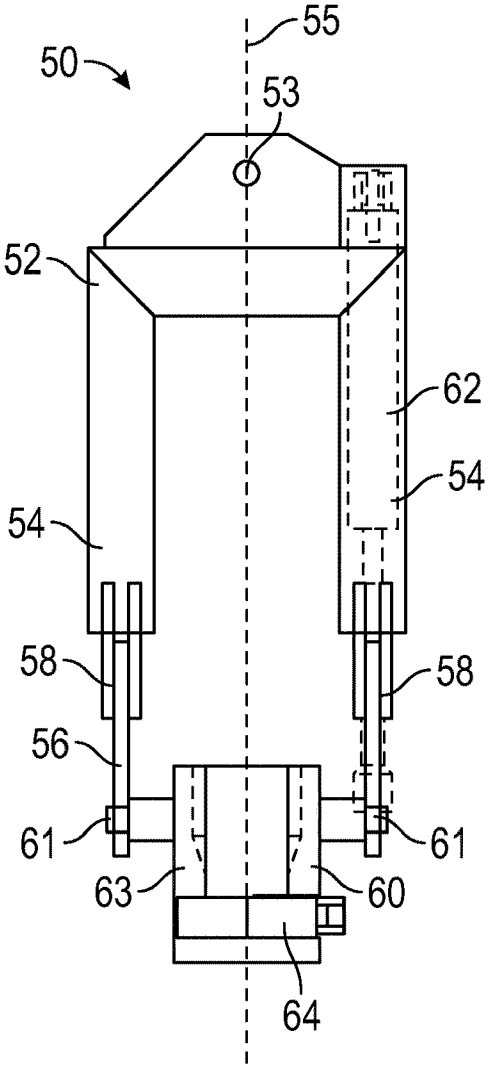
FIG. 8 is a side view of an embodiment of a pipe transport assembly of the well system of FIG. 1 in accordance with principles disclosed herein.
Figure 11:
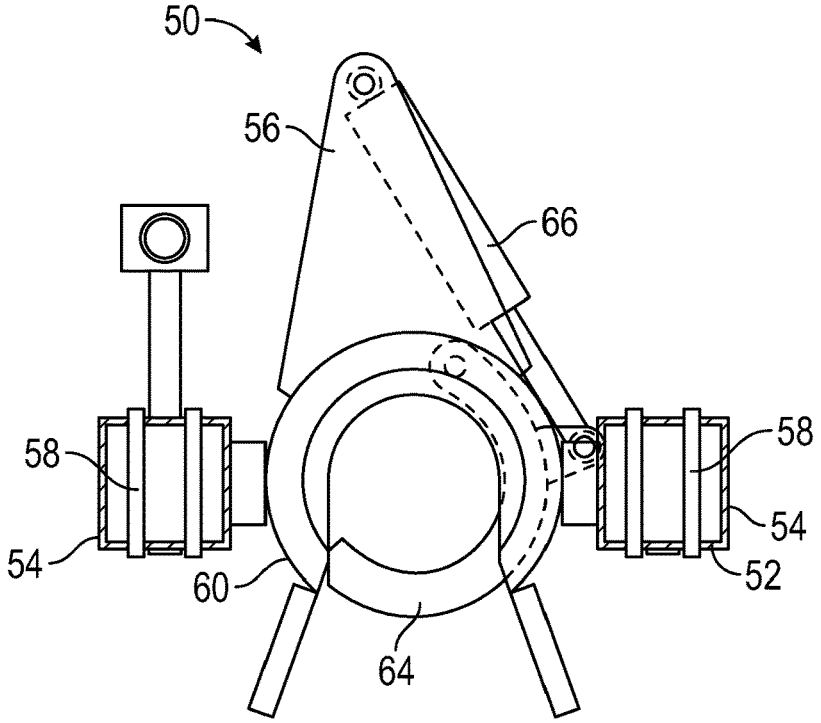
FIG. 11 is a cross-sectional view of the pipe transport assembly of FIG. 8 in a first position along line 11-11 of FIG. 9.
Figure 12:
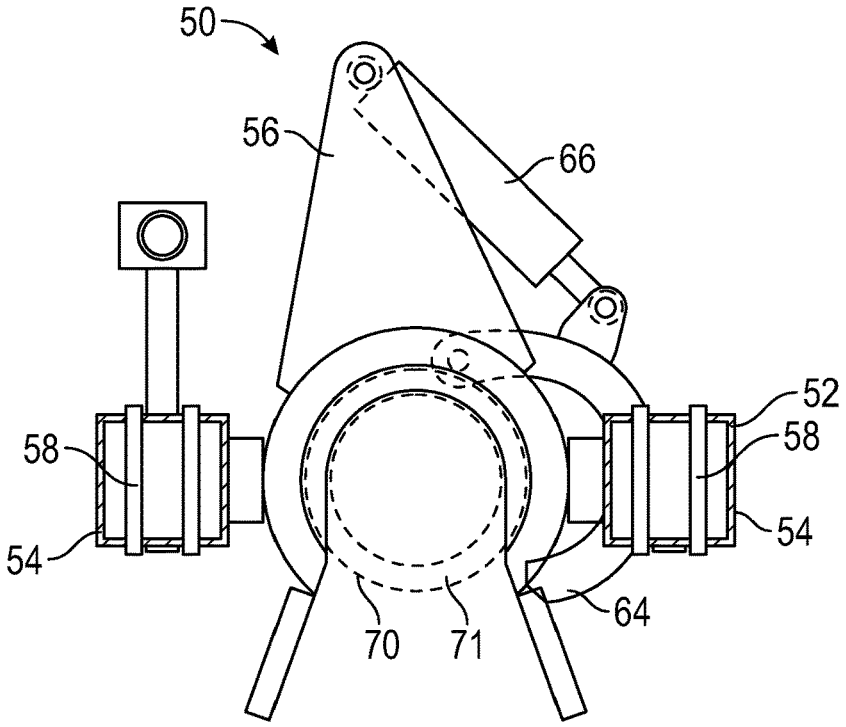
FIG. 12 is a cross-sectional view of the pipe transport assembly of FIG. 8 in a second position.
Figure 13:
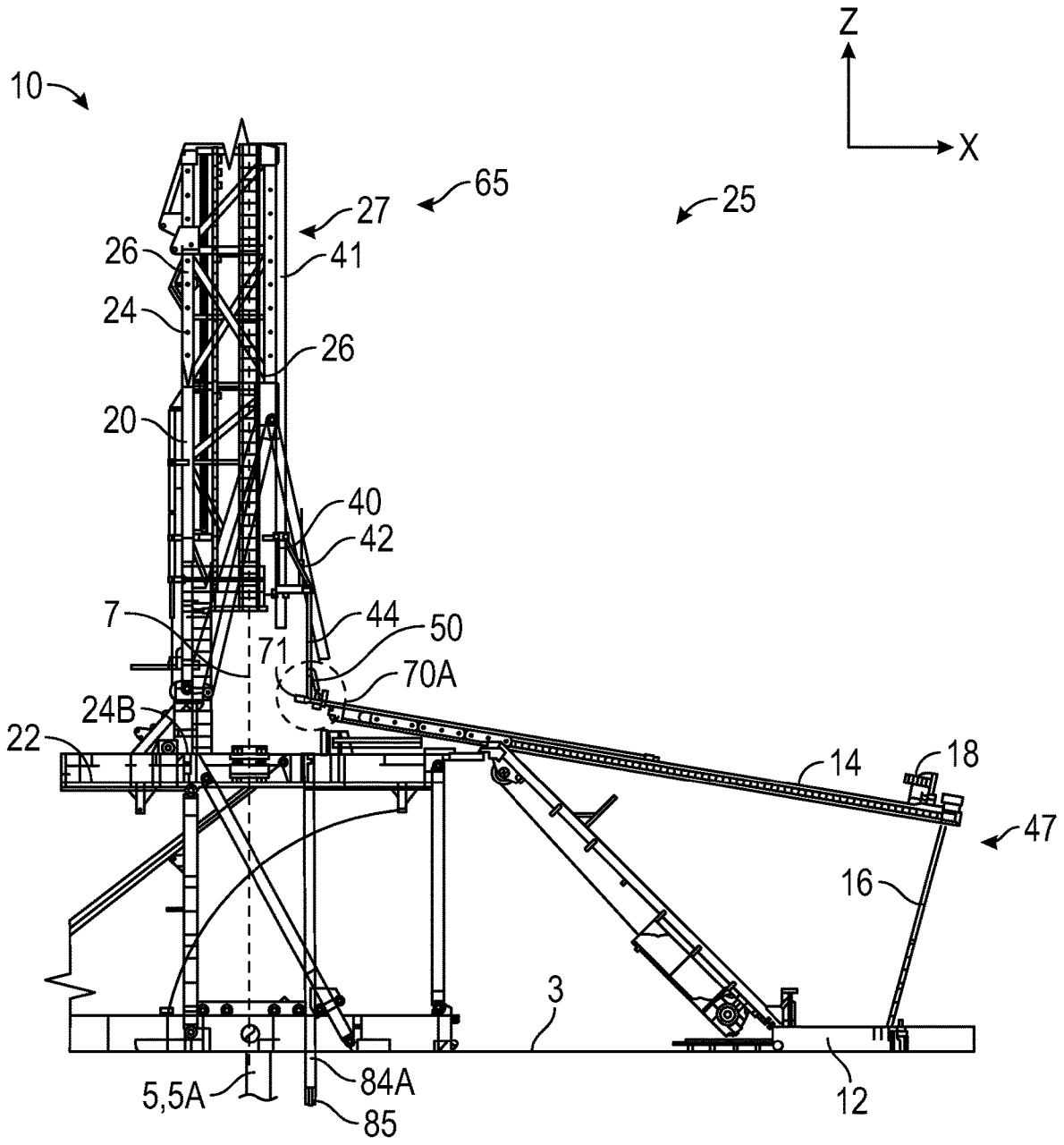
FIG. 13 is a side view of the well system of FIG. 1 in a first position.
Figure 14:
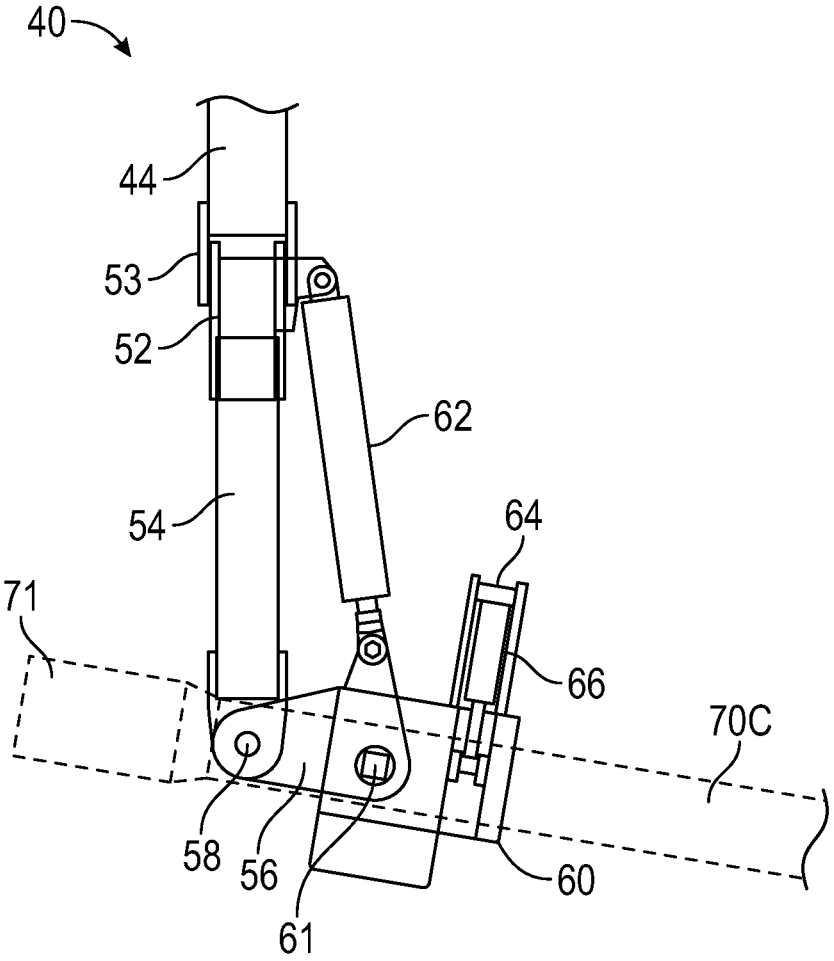
FIG. 14 is a zoomed-in view of the pipe transport assembly of the well system of FIG. 1 in the first position.

As shown particularly in FIG. 7, each robot 100A, 100B generally includes a rotary platform 102, a first pivot arm 108, a second pivot arm 114, and a guide member or claw 124. Rotary platform 102 couples first robot 100A to the rig floor 22. A first rotary actuator 104 coupled to the rotary platform 102 is configured to selectively (e.g., via a controller in signal communication with first rotary actuator 104) rotate arms 108, 114, and claw 124 about a vertically extending (i.e., extending parallel to the Z coordinate axis) first rotary axis 105.

The lower pivot arm 108 of the first robot 100A is coupled to rotary platform 102 at a first pivot joint 110 that permits relative rotation between first pivot arm 108 and the rotary platform 102 about a horizontally extending (i.e., within a horizontal plane formed by the X and Y coordinate axes) first horizontal pivot axis extending through first pivot joint 110. A first pivot actuator 112 is coupled between rotary platform 102 and first pivot arm 108 for selectively controlling the pivot position of first pivot arm 108 relative to the rotary platform 102 about the first pivot axis. Thus, first pivot actuator 112 may be controlled (e.g., via a controller in signal communication with first pivot actuator 112) to control the pivoting of first pivot arm 108 about the first pivot axis. In this embodiment, the second pivot arm 114 of the first robot 100A is coupled to first pivot arm 108 at a second pivot joint 110 that permits relative rotation between second pivot arm 114 and the first pivot arm 108 about a horizontally extending (i.e., within the horizontal plane formed by the X and Y coordinate axes) second pivot axis extending through second pivot joint 116. A second pivot actuator 118 is coupled between first pivot arm 108 and second pivot arm 114 for selectively controlling the pivot position of upper pivot arm 114 relative to the first pivot arm 108 about the second pivot axis. Thus, second pivot actuator 118 may be controlled (e.g., via a controller in signal communication with second pivot actuator 118) to control the pivoting of second pivot arm 114 about the second pivot axis.

In this embodiment, a second rotary actuator 120 is coupled to the second pivot arm 114. Second rotary actuator 120 is configured to selectively (e.g., via a controller in signal communication with second rotary actuator 120) rotate second pivot arm 114 and claw 124 about a second rotary axis 121. In this embodiment, claw 124 of the first robot 100A is coupled to second pivot arm 114 at a third pivot joint 126 that permits relative rotation between claw 124 and the second pivot arm 114 about a third pivot axis extending through third pivot joint 126. A third pivot actuator 128 is coupled between second pivot arm 114 and claw 124 for selectively controlling the pivot position of claw 124 relative to the second pivot arm 114 about the third pivot axis. Thus, third pivot actuator 128 may be controlled (e.g., via a controller in signal communication with third pivot actuator 128) to control the pivoting of claw 124 about the third pivot axis.

In this embodiment, a third rotary actuator 130 is coupled to the claw 124. Third rotary actuator 130 is configured to selectively (e.g., via a controller in signal communication with third rotary actuator 130) rotate claw 124 about a third rotary axis 131. In his embodiment, claw 124 comprises a saddle-shaped member configured to grip and guide drill pipe joints 70 and pipe stands 140 assembled therefrom. However, as will be described further herein, claw 124 is not configured to support the entire weight of drill pipe joints 70, and instead, is configured to manipulate or guide the movement of drill pipe joints 70 during the process of assembling pipe stands 140 and disposing the assembled pipe stands 140 in the setback position 65.

As described above, robots 100A, 100B are each pivotable/rotatable about six different axes (first, second, and third pivot axes, and rotary axes 105, 121, and 131) to provide movement having six separate degrees of freedom. Additionally, given that robots 100A, 100B are not required to support the entire weight of drill pipe joints 70 and the pipe stands 140 assembled therefrom (robots 100A, 100B only assist in guiding the movement of drill pipe joints 70 and the pipe stands 140 assembled therefrom), as will be described further herein, robots 100A, 100B comprise relatively inexpensive, compact, and lightweight, commercially available robots. For example, in some embodiments, robots 100A, 100B comprise readily available robots used in commercial manufacturing, such as MH225 series robots produced by Yaskawa America, Inc. of 100 Automation Way, Miamisburg, Ohio 45342. In other embodiments, robots 100A, 100B may also comprise the BX200L series of robots produced by Kawasaki Robotics (USA), Inc. of 28140 Lakeview Drive, Wixom, Michigan 48393. In this manner, robots 100A, 100B may be utilized for manipulating and guiding drill pipe joints 70 and pipe stands 140 assembled therefrom in lieu of personnel of well system 10, thereby increasing the safety of drilling operations performed by well system 10. In this manner, robots 100A, 100B may be utilized to increase the safety of well system 10 while minimizing additional costs and space taken up on rig floor 22 through the utilization of inexpensive and compact robots.

As shown particularly in FIGS. 1-3 and 5, in this embodiment, drilling platform 20 also includes a racking board 90 coupled to the mast 24 and positioned vertically above the rig floor 22. Racking board 90 is positioned on the open side 27 of mast 24 and extends longitudinally along an axis disposed parallel with the X coordinate axis. In this embodiment, racking board 90 includes two banks of finger boards 92, each bank of finger boards 92 extending in parallel along longitudinal axes disposed parallel with the Y coordinate axis. An elongate opening is formed between each adjacently disposed pairs of finger boards 92, the opening being sized to receive the box end 71 of a drill pipe joint 70.

The vertical distance between rig floor 22 and racking board 90 is sufficient such that an upper end of each pipe stand 140 assembled from drill pipe joints 70 may be received in one of the plurality of finger boards 92. In this configuration, finger boards 92 of racking board 90 are configured to secure the upper ends of the pipe stands 140 in a substantially vertical orientation in the setback position 65. Once secured in finger boards 92, the pipe stands 140 may be selectively released from finger boards 92 and attached to the top drive assembly 28 to be run into the wellbore 5.

In this embodiment, a third or racking board robot 100C (racking board robot 100C is hidden in FIG. 5 for clarity) is positioned on the racking board 90 of drilling platform 20. Racking board robot 100C is configured similarly as rig floor robots 100A, 100B described above. As will be discussed further herein, racking board robot 100C is configured for guiding the upper ends of the pipe stands 140 assembled from drill pipe joints 70 into and out of the finger boards 92 of racking board 90. As with the rig floor robots 100A, 100B, racking board robot 100C is not configured for supporting the entire weight of each pipe stand 140, which instead is supported by the pipe transport assembly 40.

Referring to FIGS. 13-21, the tubular string building and transport system 25 of well system 10 is generally configured for assembling pipe stands 140 from drill pipe joints 70 and positioning the assembled pipe stands 140 in the setback position 65 with an upper end of each pipe stand 140 secured to racking board 90. In this embodiment, tubular string building and transport system 25 generally includes pipe transport assembly 40, rig floor robots 100A, 100B, and racking board robot 100C. In an embodiment, a pipe stand 140 may be assembled by displacing a first drill pipe joint 70A from the storage position 47 along the support surface 14 of pipe ramp 12 towards the rig floor 22. As shown particularly in FIGS. 13 and 14, once the box end 71 of the first drill pipe joint 70A is positioned over the rig floor 22, locking member 64 of the elevator 50 of pipe transport assembly 40 may be actuated into the open position. Additionally, second pivot actuator 62 of elevator 50 may be fully retracted to permit the box end 71 of the first drill pipe joint 70A to be inserted into pipe support member 60. With the box end 71 of the first drill pipe joint 70A inserted into pipe support member 60, locking member 64 may be actuated into the closed position via lock actuator 66 to secure or lock the first drill pipe joint 70A.

Figure 15:
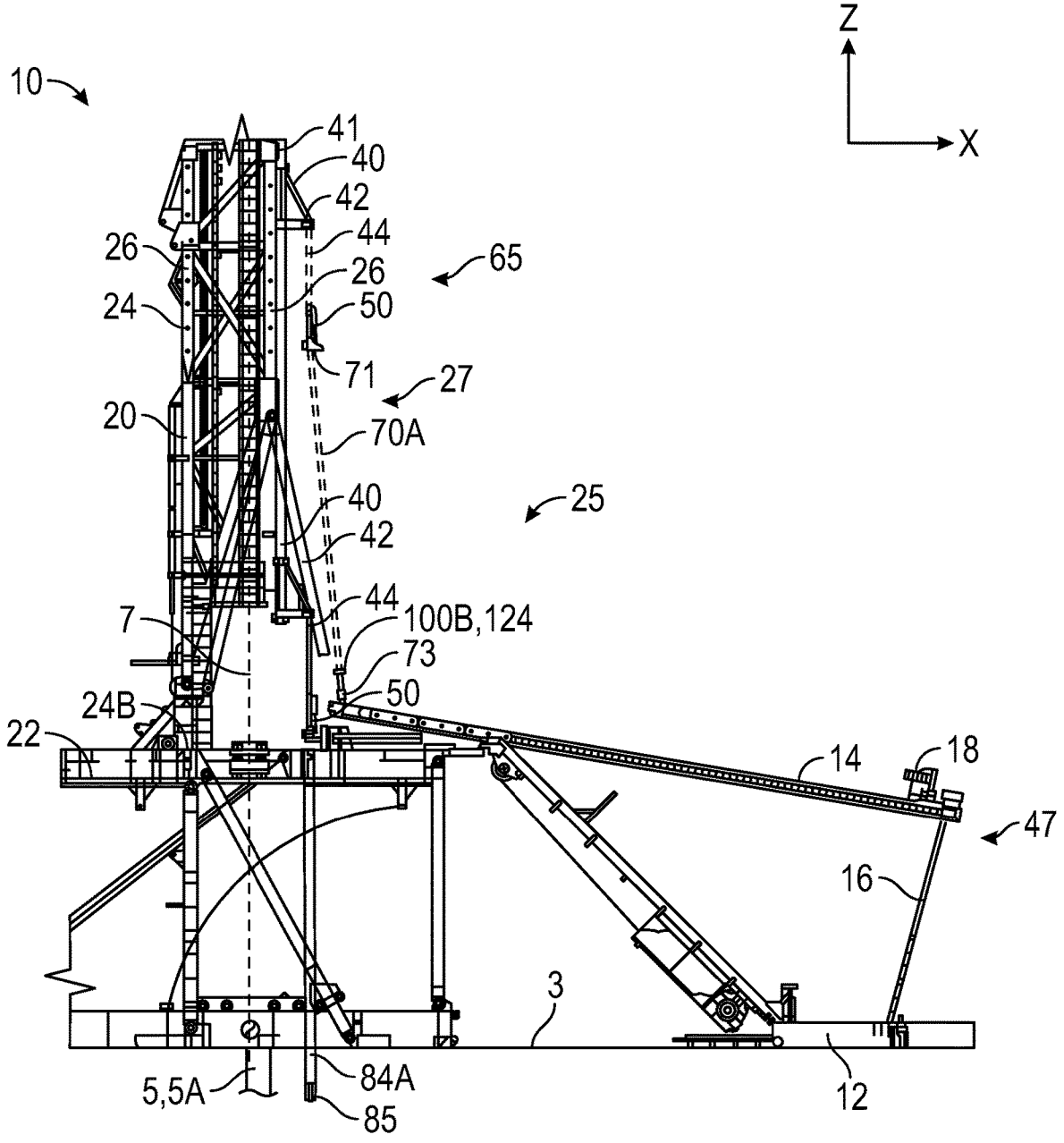
FIG. 15 is a side view of the well system of FIG. 1 in a second position.
Figure 16:
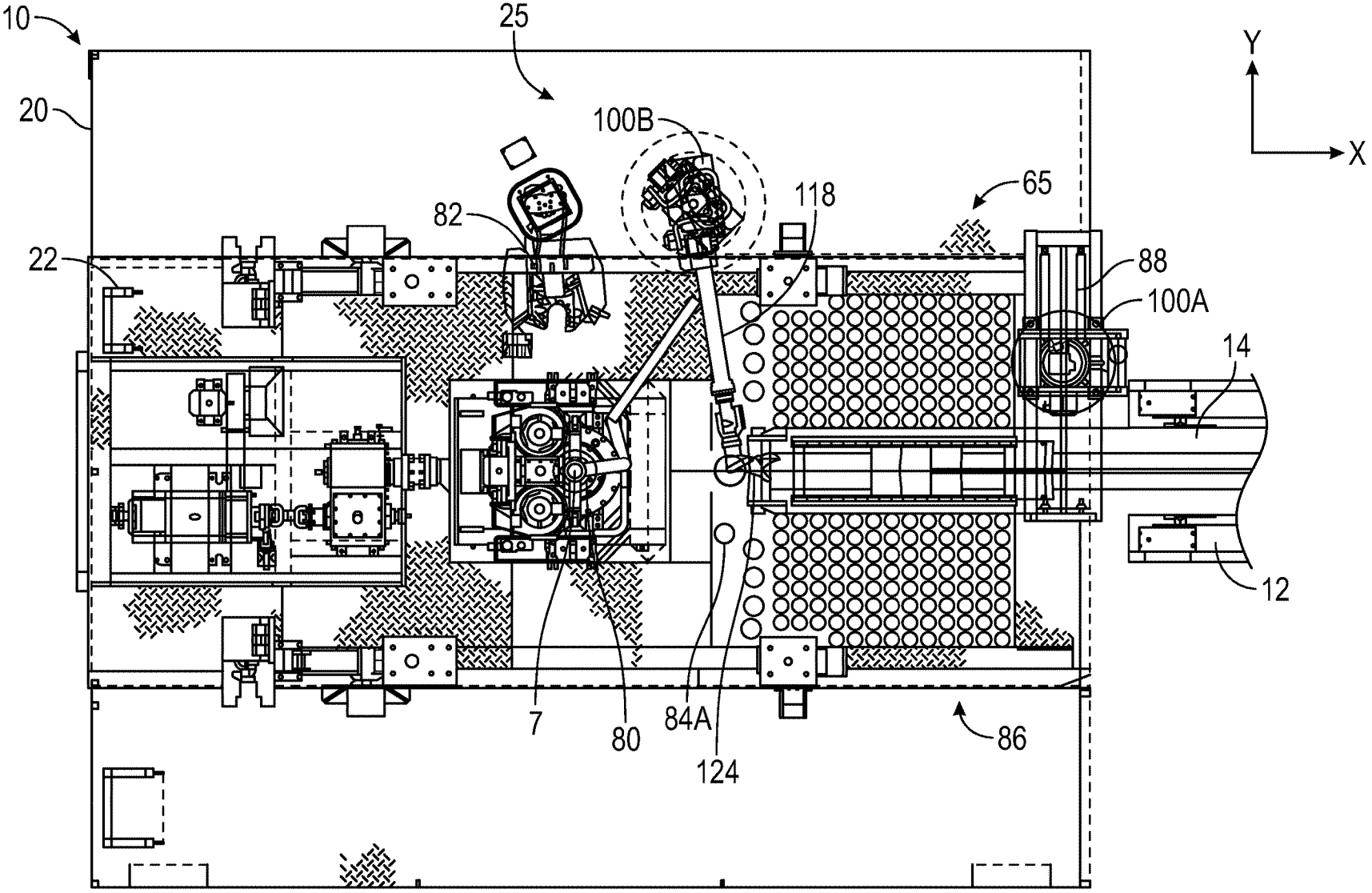
FIG. 16 is a top view of the rig floor of the well system of FIG. 1 in the second position.

As shown particularly in FIG. 15, with the box end 71 of the first drill pipe joint 70A secured to the elevator 50 of pipe transport assembly 40, winch 48 may be actuated to displace the pipe transport assembly 40 vertically along track 41 towards the upper end 24A of mast 24. Pipe transport assembly 40 is displaced upwards along track 41 until the first drill pipe joint 70A is disposed in a slightly inclined orientation with the weight of the first drill pipe joint 70A supported by pipe transport assembly 40, at which point the pipe transport assembly 40 ceases travelling along track 41. With the first drill pipe joint 70A disposed in a slightly inclined orientation and physically supported by pipe transport assembly 40, second rig floor robot 100B may be actuated to guide a lower or pin end 73 of the first drill pipe joint 70A from the support surface 14 of pipe ramp 12 towards the first mouse hole 84A of the rig floor 22. As shown particularly in FIGS. 16 and 17, utilizing the six degrees of freedom provided by the second rig floor robot 100B, the claw 124 of robot 100B contacts or grips the pin end 73 of first drill pipe joint 73 to guide or swing the pin end 73 of the first drill pipe joint 70A from the slightly inclined orientation to a substantially vertical orientation while the weight of the first drill pipe joint 70A is supported by pipe transport assembly 40.

As the claw 124 of the second rig floor robot 100B guides the pin end 73 of the first drill pipe joint 70A into a substantially vertical orientation, the first pivot actuator 46 is retracted to displace the first drill pipe joint 70A horizontally along an axis parallel to the Y coordinate axis until the central axis 75 of the first drill pipe joint 70A is substantially aligned with a central or longitudinal axis of the first mouse hole 84A. In other embodiments, pipe transport assembly 40 may not include a first pivot actuator 46 and the claw 124 of second rig floor robot 100B may be used to displace the first drill pipe joint 70A horizontally into alignment with the first mouse hole 84A. Once the central axis 75 of first drill pipe joint 70A is aligned with the central axis of the first mouse hole 84A, winch 48 may be actuated to lower pipe transport assembly 40 and the first drill pipe joint 70A towards the rig floor 22, thereby inserting the first drill pipe joint 70A into the first mouse hole 84A. First drill pipe joint 70A is lowered through first mouse hole 84A by pipe transport assembly 40 until the pin end 73 of first drill pipe joint 70A is supported by a lower terminal end 85 of the first mouse hole 84A, thereby positioning the box end 71 of first drill pipe joint 70A at the rig floor 22 near an upper end of first mouse hole 84A.

Figure 17:
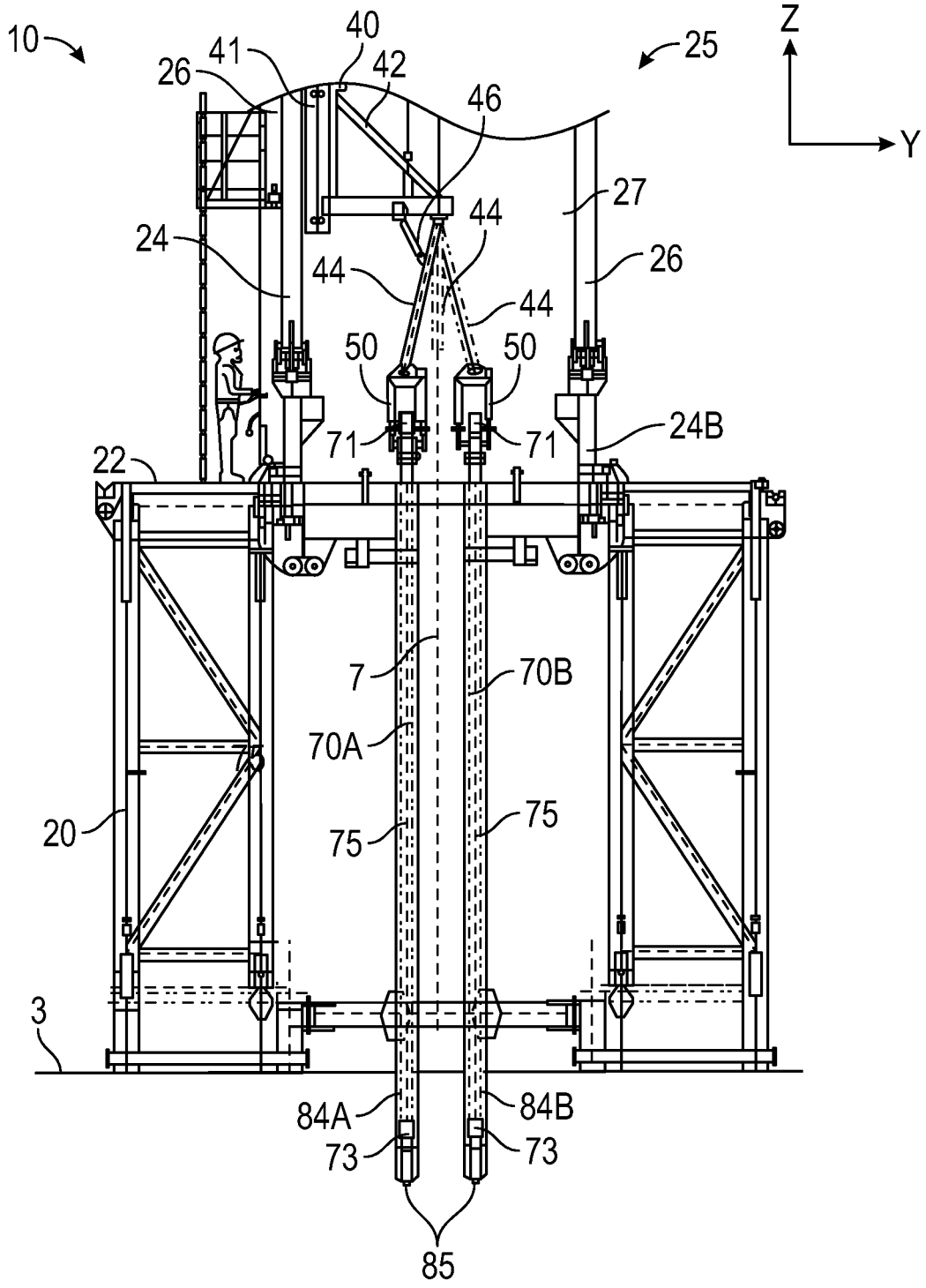
FIG. 17 is a front view of the well system of FIG. 1 in the second position.

As shown particularly in FIG. 17, the process described above with respect to first drill pipe joint 70A may be repeated with a second drill pipe joint 70B delivered to rig floor 22 from the storage position 47 by pipe ramp 12. Particularly, a box end 71 of the second drill pipe joint 70B may be secured to the elevator 50 of pipe transport assembly 40 via pipe support member 60 and locking member 64. The box end 71 of second drill pipe joint 70B may then be transported vertically upwards along with pipe transport assembly 40 via the actuation of winch 48. When the second drill pipe joint 70B is disposed in a slightly inclined position with the weight of pipe joint 70B supported by pipe transport assembly 40, the actuation of winch 48 may cease travelling upwards and the claw 124 of second rig floor robot 100B may be used to guide a pin end 73 of the second drill pipe joint 70B towards second mouse hole 84B in concert with the extension of pivot actuator 46 of pipe transport assembly 40. Claw 124 of second rig floor robot 100B guides second drill pipe joint 70B into a substantially vertical orientation while the extension of pivot actuator 46 displaces second drill pipe joint 70B horizontally in a direction parallel with the Y coordinate axis until a central axis 75 of the second drill pipe joint 70B enters into substantial alignment with the central axis of the second mouse hole 84B. With the second drill pipe joint 70B aligned with second mouse hole 84B, winch 48 may be actuated to lower pipe transport assembly 40 and the second drill pipe joint 70B towards the rig floor 22, thereby inserting the second drill pipe joint 70B into the second mouse hole 84B and displacing pipe joint 70B through second mouse hole 84B until the pin end 73 of pipe joint 70B is positioned at the lower terminal end 85 of second mouse hole 84B.

Figure 18:
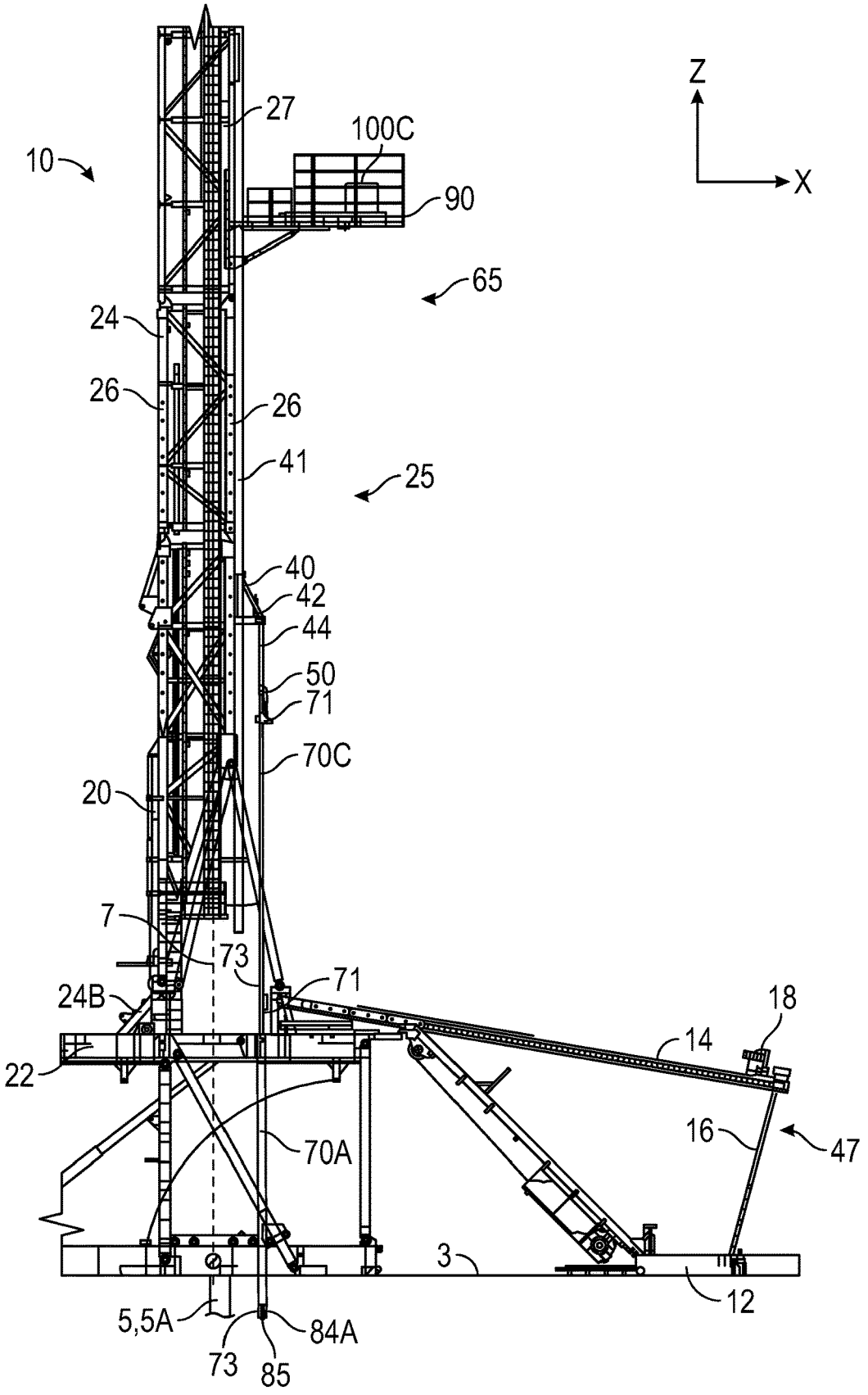
FIG. 18 is a side view of the well system of FIG. 1 in a third position.

In this embodiment, as shown particularly in FIG. 18, once the first drill pipe joint 70A is received in the first mouse hole 84A of rig floor 22 and the second drill pipe joint 70B is received in the second mouse hole 84B, a third drill pipe joint 70C is delivered to rig floor 22 from the storage position 47 by pipe ramp 12. A box end 71 of the third drill pipe joint 70C is then secured to the elevator 50 of pipe transport assembly 40 via pipe support member 60. The box end 71 of third drill pipe joint 70C is then transported vertically upwards along with pipe transport assembly 40 via the actuation of winch 48. In this embodiment, pipe transport assembly 40 and the box end 71 of third drill pipe joint 70C continues to travel upwards until third drill pipe joint 70C is disposed in a slightly inclined orientation, at which point the claw 124 of the second rig floor robot 100B grips a pin end 73 of the third drill pipe joint 70C and guides the pin end 73 until the third drill pipe joint 70C is disposed in a substantially vertical orientation. As the second rig floor robot 100B guides the third drill pipe joint 70C into the substantially vertical orientation, pivot actuator 46 of pipe transport assembly 40 is extended to displace third drill pipe joint 70C horizontally in a direction parallel with the Y coordinate axis until a central axis 75 of the third drill pipe joint 70C is substantially aligned with the central axis 75 of the second drill pipe joint 70B, the third drill pipe joint 70C being suspended vertically above second drill pipe joint 70B.

In this embodiment, with third drill pipe joint 70C suspended from pipe transport assembly 40 above second drill pipe joint 70B, third drill pipe joint 70C may be lowered to insert the pin end 73 of third drill pipe joint 70C into the box end 71 of second drill pipe joint 70B. In some embodiments, the claw 124 of second rig floor robot 100B grips the pin end 73 of third drill pipe joint 70C to assist with guiding the pin end 73 of third drill pipe joint 70C into the box end 71 of second drill pipe joint 70B. Once the pin end 73 of third drill pipe joint 70C is inserted into the box end 71 of second drill pipe joint 70B, power tongs 82 are actuated to threadably couple third drill pipe joint 70C with second drill pipe joint 70B.

In this embodiment, with third drill pipe joint 70C suspended from pipe transport assembly 40 and second drill pipe joint 70B coupled with third drill pipe joint 70C, winch 48 is actuated to lift drill pipe joints 70B, 70C vertically towards the upper end 24A of mast 24. Pipe transport assembly 40 and drill pipe joints 70B, 70C travel upwards until the pin end 73 of second drill pipe joint 70B is removed from the second mouse hole 84B of rig floor 22. Once the pin end 73 of second drill pipe joint 70B is removed from second mouse hole 84B, the actuation of winch 48 ceases and pivot actuator 46 of pipe transport assembly 40 is actuated to displace drill pipe joints 70B, 70C horizontally until the central axes 75 of drill pipe joints 70B, 70C enter into alignment with the central axis 75 of the first drill pipe joint 70C received in the first mouse hole 84A with the pin end 73 of second drill pipe joint 70B being suspended above the box end 71 of first drill pipe joint 70A.

With drill pipe joints 70B, 70C suspended above first drill pipe joint 70A, winch 48 is actuated to lower drill pipe joints 70B, 70C towards first drill pipe joint 70A with the pin end 73 of second drill pipe joint 70B being inserted into the box end 71 of first drill pipe joint 70A. In some embodiments, the claw 124 of second rig floor robot 100B grips the pin end 73 of second drill pipe joint 70B to assist with the guiding pin end 73 of second drill pipe joint 70B into the box end 71 of first drill pipe joint 70A. Once the pin end 73 of second drill pipe joint 70B is inserted into the box end 71 of first drill pipe joint 70A, power tongs 82 are actuated to threadably couple the second drill pipe joint 70B with the first drill pipe joint 70A, thereby forming pipe stand 140 from drill pipe joints 70A, 70B, and 70C.

Figure 19:
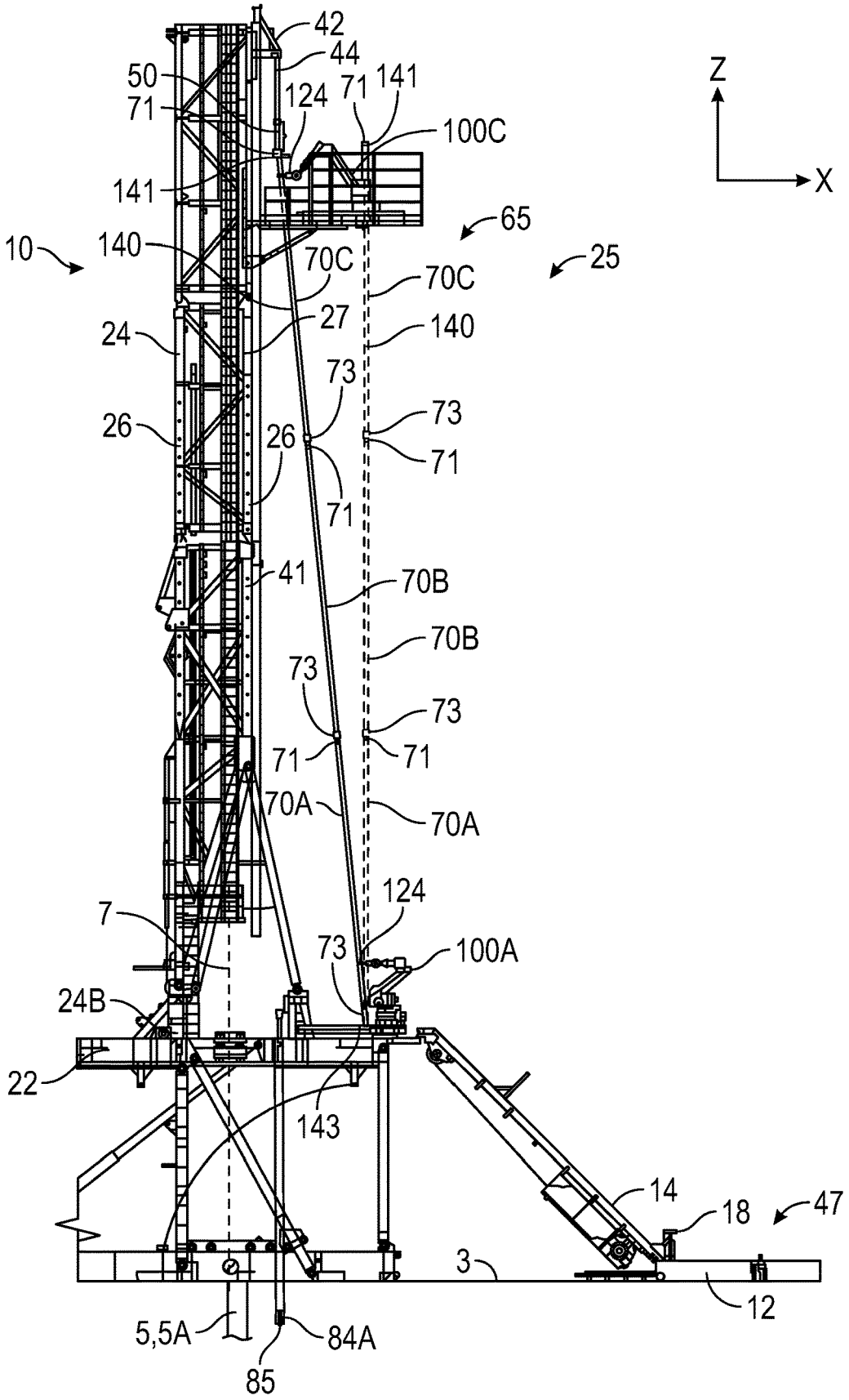
FIG. 19 is a side view of the well system of FIG. 1 in a fourth position.
Figure 20:
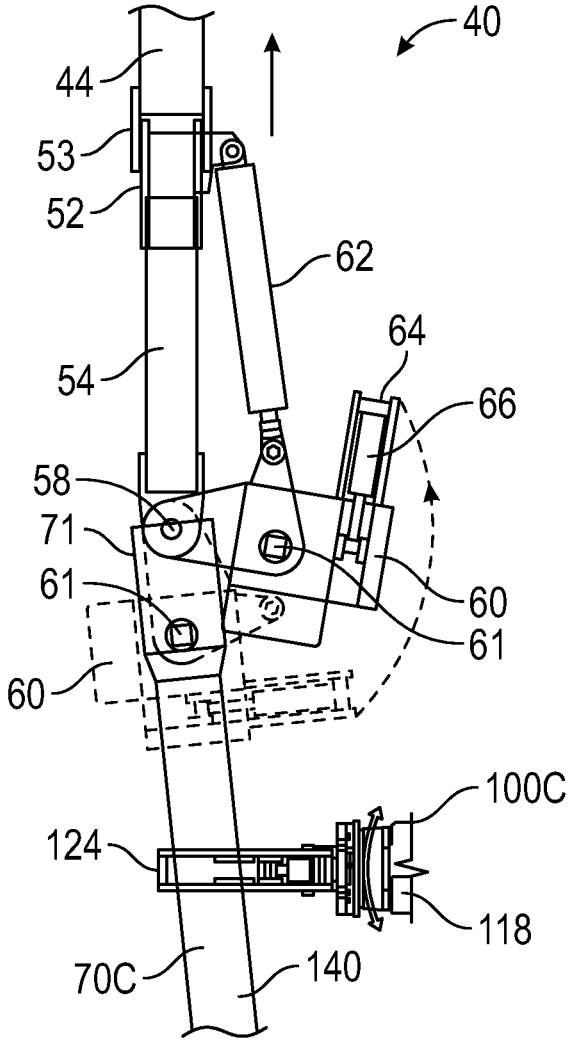
FIG. 20 is a top view of the rig floor of the well system of FIG. 1 in the fourth position.
Figure 21:
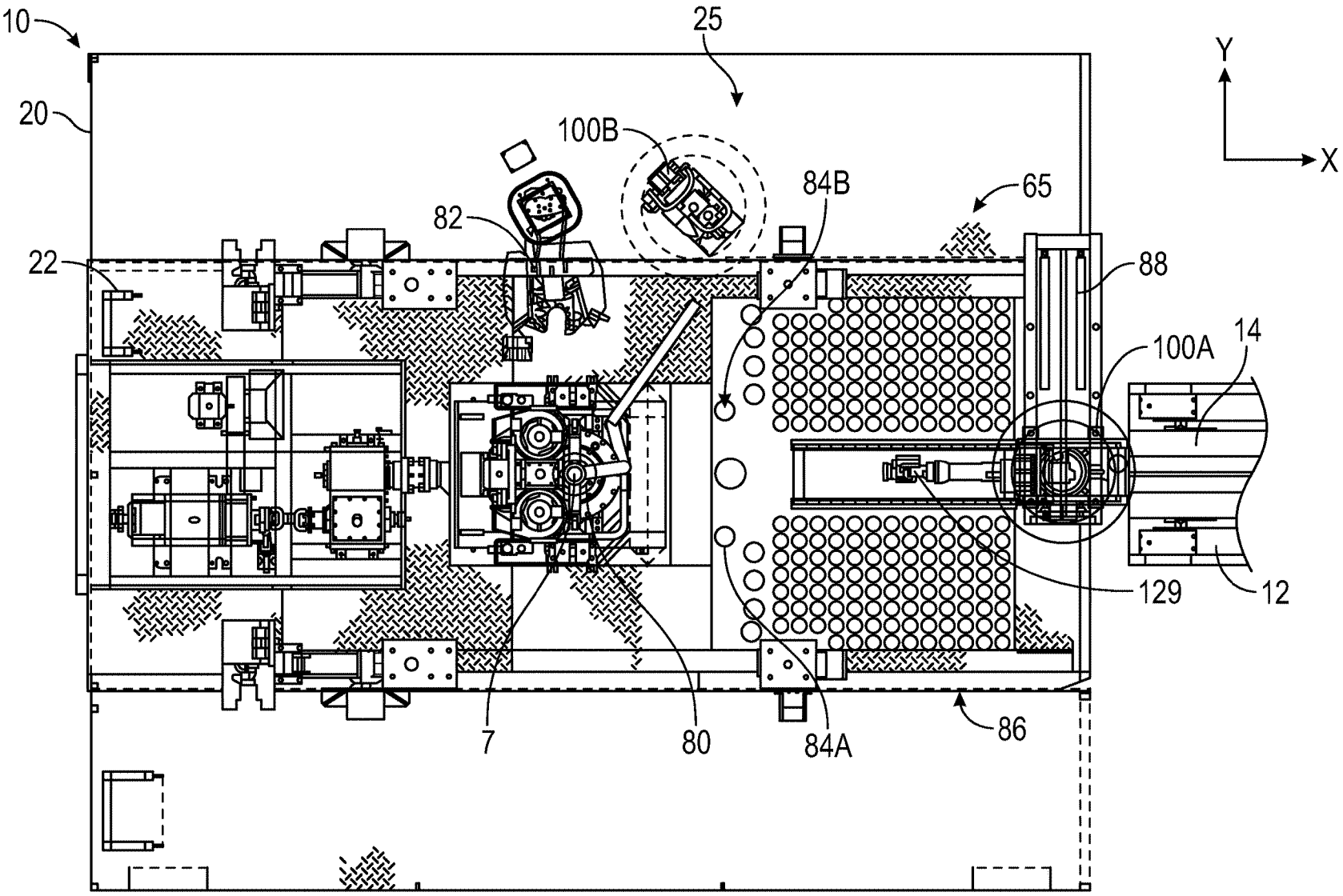
FIG. 21 is a top view of the rig floor of the well system of FIG. 1 in the fourth position.

As shown particularly in FIGS. 19-21, with drill pipe joints 70A, 70B, and 70C coupled together to form pipe stand 140, winch 48 is actuated to vertically lift pipe stand 140 upwards until the pin end 71 of the third drill pipe joint 70C of pipe stand 140 (forming an upper end 141 of pipe stand 140) is positioned above racking board 90 and the pin end 73 of the first drill pipe joint 70A (forming a lower end 143 of pipe stand 140) is positioned at the rig floor 22. In this embodiment, with the upper end 141 of pipe stand 140 positioned above racking board 90, the actuation of winch 48 is ceased and the first drill floor robot 100A is displaced along track 88 in a horizontal direction parallel with the Y coordinate axis from a first or parked position (shown in FIG. 16) to a second or working position (shown in FIG. 21). Once the first rig floor robot 100A is disposed in the working position, claw 124 of first rig floor robot 100A grips the lower end 143 of pipe stand 140 and guides the lower end 143 of pipe stand 140 into the setback position 65 (shown in FIG. 19) with the lower end 143 of pipe stand 140 positioned on the support deck 86 of rig floor 22. As first rig floor robot 100A guides the lower end 143 of pipe stand 140 into the setback position 65, the weight of pipe stand 140 is supported by pipe transport assembly 40 via engagement between the upper end 141 of pipe stand 140 and the pipe support member 60 of pipe transport assembly 40.

With the lower end 143 of pipe stand 140 disposed in the setback position 65 and the upper end 141 of pipe stand 140 attached to pipe transport assembly 40, pipe stand 140 is disposed in a slightly inclined orientation (indicated via the solid-lined pipe stand 140 in FIG. 19). In this configuration, the claw 124 of racking board robot 100C extends towards and grips the upper end 141 of pipe stand 140 to stabilize the orientation of pipe stand 140. Once pipe stand 140 is stabilized by racking board robot 100C, locking member 64 of elevator 50 is actuated into the open position and second pivot actuator 62 is retracted (shown in FIG. 20) to unhook the upper end 141 of pipe stand 140 from the elevator 50 of pipe transport assembly 40. In some embodiments, winch 48 is actuated to displace pipe transport assembly 40 slightly upwards in conjunction with the retraction of second pivot actuator 62 to assist with releasing the upper end 141 of pipe stand 140 from elevator 50.

Once the upper end 141 of pipe stand 140 is released from the elevator 50 of pipe transport assembly 40, racking board robot 100C is actuated to position and secure the upper end 141 of pipe stand 140 between a pair of finger boards 92 of racking board 90 with pipe stand 140 disposed in a substantially vertical orientation (indicated via the dash-lined pipe stand 140 in FIG. 19) in the setback position 65. The process described above of assembling pipe stand 140 from drill pipe joints 70A, 70B, and 70C, and racking the assembled pipe stand 140 in the setback position 65 secured to racking board 90 may be repeated to dispose additional pipe stands 140 in the setback position 65 and secured to racking board 90. Additionally, in some embodiments, racking board robot 100C may be used to guide the upper end 141 of a pipe stand 140 into engagement with the elevator 30 of top drive assembly 28 when it is desired to insert the pipe stand 140 into wellbore 5.

In the embodiment described above, the pipe transport assembly 40 and robots 100A, 100B, and 100C of tubular string building and transport system 25 may be utilized to safely assemble pipe stands 140 and deposit the assembled pipe stands 140 in the setback position 65. The use of tubular string building and transport system 25 may increase the safety of assembling and positioning pipe stands 140 by reducing or eliminating the presence of personnel of well system 10 on rig floor 22 and racking board 90 for the purpose of guiding the ends of drill pipe joints 70A, 70B, 70C. Instead, the functions of guiding drill pipe joints 70A, 70B, and 70C during the process of assembling and positioning pipe stands 140 may be performed by robots 100A, 100B, and 100C without exposing personnel of well system 10 to any risks or dangers encountered on rig floor 22 and racking board 90. Additionally, given that robots 100A, 100B, 100C are not required to support the weight of drill pipe joints 70A, 70B, and 70C during the process of assembling and positioning pipe stands 140, robots 100A, 100B, and 100C of tubular string building and transport system 25 comprise relatively inexpensive and compact robots that may provide for six degrees of freedom of movement for more fluidly and efficiently guiding drill pipe joints 70A, 70B, and 70C.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A well system, comprising:

a well platform comprising a rig floor;

a first rig floor robot and a second rig floor robot positioned on the rig floor, wherein the first rig floor robot is configured to guide a lower end of a pipe stand towards a setback position on the rig floor and the second rig floor robot is configured to guide a first pipe joint of the pipe stand laterally across the rig floor and into a first mouse hole formed in the rig floor;

a mast extending from the rig floor;

a racking board coupled to the mast, the racking board configured to secure an upper end of the pipe stand between a pair of finger boards of the racking board; and a racking board robot positioned on the racking board and configured to position the upper end of the pipe stand between the pair of finger boards.

2. The well system of claim 1, wherein the first rig floor robot, the second rig floor robot, and the racking board robot each comprise a guide member having six degrees of freedom.

3. The well system of claim 1, wherein the first rig floor robot comprises:

a rotary platform;

a first rotary actuator coupled to the rotary platform and configured to rotate the rotary platform about a first rotational axis;

a first pivot arm pivotably coupled to the rotary platform;

a second pivot arm pivotably coupled to the first pivot arm;

a second rotary actuator coupled to the second pivot arm and configured to rotate the second pivot arm about a second rotational axis; and a claw pivotably coupled to the second pivot arm.

4. The well system of claim 1, wherein the first rig floor robot is slidably disposed on a track positioned on the rig floor.

5. The well system of claim 1, wherein the second rig floor robot is configured to guide a second pipe joint of the pipe stand into a second mouse hole formed in the rig floor that is spaced from the first mouse hole.

6. The well system of claim 1, further comprising a pipe transport assembly slidably coupled to one of the legs of the mast, wherein the pipe transport assembly comprises an elevator configured to transport the pipe stand.

7. The well system of claim 6, further comprising an actuator coupled to the mast and configured to raise and lower the pipe transport assembly along a rail coupled to the mast.

8. The well system of claim 1, wherein the second rig floor robot is configured to guide the first pipe joint from a pipe ramp located adjacent the rig floor into the first mouse hole.

9. A well system, comprising:

a well platform comprising a rig floor;

a first rig floor robot and a second rig floor robot positioned on the rig floor, wherein the first rig floor robot is slidably disposed on a track positioned on the rig floor and configured to guide a lower end of a pipe stand towards a setback position on the rig floor, and the second rig floor robot is configured to guide a first pipe joint of the pipe into a first mouse hole formed in the rig floor;

a mast extending from the rig floor;

a racking board coupled to the mast, the racking board configured to secure an upper end of the pipe stand between a pair of finger boards of the racking board; and a racking board robot positioned on the racking board and configured to position the upper end of the pipe stand between the pair of finger boards.

10. The well system of claim 9, wherein the first rig floor robot, the second rig floor robot, and the racking board robot each comprise a guide member having six degrees of freedom.

11. The well system of claim 9, wherein the first rig floor robot comprises:

a rotary platform;

a first rotary actuator coupled to the rotary platform and configured to rotate the rotary platform about a first rotational axis;

a first pivot arm pivotably coupled to the rotary platform;

a second pivot arm pivotably coupled to the first pivot arm;

a second rotary actuator coupled to the second pivot arm and configured to rotate the second pivot arm about a second rotational axis; and a claw pivotably coupled to the second pivot arm.

12. The well system of claim 9, further comprising a pipe transport assembly slidably coupled to one of the legs of the mast, wherein the pipe transport assembly comprises an elevator configured to transport the pipe stand.

13. The well system of claim 12, further comprising an actuator coupled to the mast and configured to raise and lower the pipe transport assembly along a rail coupled to the mast.

14. A well system, comprising:

a well platform comprising a rig floor;

a first rig floor robot and a second rig floor robot positioned on the rig floor, wherein the first rig floor robot is configured to guide a lower end of a pipe stand towards a setback position on the rig floor, and the second rig floor robot is configured to guide a first pipe joint of the pipe into a first mouse hole formed in the rig floor and to guide a second pipe joint of the pipe stand into a second mouse hole formed in the rig floor that is spaced from the first mouse hole;

a mast extending from the rig floor;

a racking board coupled to the mast, the racking board configured to secure an upper end of the pipe stand between a pair of finger boards of the racking board; and a racking board robot positioned on the racking board and configured to position the upper end of the pipe stand between the pair of finger boards.

15. The well system of claim 14, wherein the first rig floor robot, the second rig floor robot, and the racking board robot each comprise a guide member having six degrees of freedom.

16. The well system of claim 14, wherein the first rig floor robot comprises:

a rotary platform;

a first rotary actuator coupled to the rotary platform and configured to rotate the rotary platform about a first rotational axis;

a first pivot arm pivotably coupled to the rotary platform;

a second pivot arm pivotably coupled to the first pivot arm;

a second rotary actuator coupled to the second pivot arm and configured to rotate the second pivot arm about a second rotational axis; and a claw pivotably coupled to the second pivot arm.

17. The well system of claim 14, further comprising a pipe transport assembly slidably coupled to one of the legs of the mast, wherein the pipe transport assembly comprises an elevator configured to transport the pipe stand.

18. The well system of claim 17, further comprising an actuator coupled to the mast and configured to raise and lower the pipe transport assembly along a rail coupled to the mast.

* * * * *